US010573948B2

(12) United States Patent
Rajendran et al.

(10) Patent No.: US 10,573,948 B2
(45) Date of Patent: Feb. 25, 2020

(54) SHAPED MAGNETIC BIAS CIRCULATOR

(71) Applicant: Raytheon Company, Waltham, MA (US)

(72) Inventors: Sankerlingam Rajendran, Plano, TX (US); James A. Carr, Fountain Valley, CA (US); Cary C. Kyhl, Grapevine, TX (US); Karl L. Worthen, Dallas, TX (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 16/532,879

(22) Filed: Aug. 6, 2019

(65) Prior Publication Data

US 2019/0363416 A1 Nov. 28, 2019

Related U.S. Application Data

(62) Division of application No. 15/999,435, filed on Aug. 20, 2018, now Pat. No. 10,431,865, which is a (Continued)

(51) Int. Cl.
*H01P 1/38* (2006.01)
*H01P 1/387* (2006.01)
(Continued)

(52) U.S. Cl.
CPC ..... *H01P 1/387* (2013.01); *H01F 7/021* (2013.01); *H01F 7/0273* (2013.01); *H01P 1/383* (2013.01); *H01F 7/0205* (2013.01)

(58) Field of Classification Search
CPC .. H01P 1/39; H01P 1/387; H01P 1/383; H01P 1/38; H01P 1/36; H01F 7/02; H01F 7/0205; H01F 7/021; H01F 7/0273
(Continued)

(56) References Cited

U.S. PATENT DOCUMENTS 3,758,878 A 9/1973 Wainwright
4,390,853 A 6/1983 Mathew et al.
(Continued)

OTHER PUBLICATIONS

"Magnetic Super Resolution", Magnetic Super Resolution White Paper, Fujitsu Computer Products of America, Inc., Jan. 1, 2008, 5 pages.

(Continued)

*Primary Examiner* — Stephen E. Jones
(74) *Attorney, Agent, or Firm* — Daly, Crowley, Mofford & Durkee, LLP

(57) ABSTRACT

A circulator is provided, comprising, first second and third conductors forming three equally spaced junctions and a permanent magnet configured to apply a shaped bias magnetic field to a ferrite resonator in operable communication with the first, second, and third conductors. The permanent magnet comprises a substantially planar monolithic structure having defined thereon at least first and second substantially concentric regions having first and second respective magnetic field strength levels, wherein the second magnetic field strength level is lower than the first magnetic field strength level. The first and second magnetic field strength levels are configured to cooperate to shape an external bias magnetic field of the permanent magnet to counteract at least a portion of a demagnetizing effect resulting from of an overall shape of the ferrite resonator, to achieve a substantially uniform internal magnetic bias within at least a portion of the ferrite resonator.

20 Claims, 16 Drawing Sheets

Related U.S. Application Data division of application No. 15/062,686, filed on Mar. 7, 2016, now Pat. No. 10,096,879.

(51) Int. Cl.
*H01P 1/383* (2006.01)
*H01F 7/02* (2006.01)

(58) Field of Classification Search
USPC ..... 333/1.1, 24.2
See application file for complete search history.

(56) References Cited

U.S. PATENT DOCUMENTS

| | | | |
|---|---|---|---|
| 4,704,588 | A | 11/1987 | Kane |
| 6,107,895 | A | 8/2000 | Butland et al. |
| 6,317,010 | B1 | 11/2001 | Butland et al. |
| 7,242,264 | B1 | 7/2007 | How |
| 7,982,568 | B2 | 7/2011 | Fullerton et al. |
| 8,179,219 | B2 | 5/2012 | Fullerton et al. |
| 8,760,250 | B2 | 6/2014 | Fullerton et al. |
| 9,367,783 | B2 | 6/2016 | Fullerton et al. |
| 10,096,879 | B2 | 10/2018 | Rajendran et al. |
| 2004/0151978 | A1 | 8/2004 | Huang |
| 2014/0299668 | A1 | 10/2014 | Fullerton et al. |
| 2019/0027799 | A1 | 1/2019 | Rajendran et al. |

OTHER PUBLICATIONS

"Use of Ferrimagnetic Material in Circulators", Application Note, Trans-Tech Ceramics and Advanced Materials, May 14, 2013, 3 pages.

Dimos et al., "Direct-Write Fabrication of Integrated, Multilayer Ceramic Components", Sandia National Laboratories, Albuquerque, NM, 8 pages.

Lee et al., "Magnetic Parameters for Ultra-high Frequency (UHF) Ferrite Circulator Design", Journal of Magnetics 19(4), 399-403 (2014). http://dx.doi.org/10.4283/JMAG.2014.19.4.399. 5 pages.

Nguyen, Tong, "Stripline Circulator", Final Project EE172 course, San Jose State University, College of Engineering, Department of Electrical Engineering, May 28, 2011, 16 pages.

Risser Jr., Vilas Vernon, "Design and construction of microstrip circulators", Retrospective Theses and Dissertations, 1969, Digital Repository @ Iowa State University, 88 pages.

O'Neil et al., "Experimental Investigation of a Self-Biased Microstrip Circulator;" Proceedings of the IEEE Transactions on Microwave Theory and Techniques, vol. 57, No. 7; Jul. 2009; 6 Pages.

De Santis et al., "Symmetrical Four-Port Edge-Guided Wave Circulators;" Proceedings of the IEEE Transactions on Microwave Theory and Techniques, vol. MTT-24, No. 1; Jan. 1976; 9 Pages.

Schloemann et al., "Broad-Band Stripline Circulators Based on YIG and Li-Ferrite Single Crystals;" Proceedings of the IEEE Transactions on Microwave Theory and Techniques, vol. MTT-34, No. 12; Dec. 1986; 7 Pages.

PCT Search report and Written Opinion dated May 10, 2017 for International Application No. PCT/US2017/013263; 16 Pages.

U.S. Restriction Requirement dated Dec. 6, 2017 for U.S. Appl. No. 15/062,686; 9 Pages.

Response to U.S. Restriction Requirement dated Dec. 6, 2017 for U.S. Appl. No. 15/062,686; Response filed Feb. 6, 2018; 1 Page.

Notice of Allowance dated May 18, 2018 for U.S. Appl. No. 15/062,686; 8 Pages.

PCT International Preliminary Report dated Sep. 20, 2018 for International Application No. PCT/US2017/013263; 9 Pages.

Communication Pursuant to Rules 161(1) and 162(EPC) dated Aug. 7, 2018 for European Application No. 17704854.3; 3 Pages.

Response (with Amended Claims) to Communication Pursuant to Rules 161(1) and 162(EPC) dated Aug. 7, 2018 for European Application No. 17704854.3; Response Filed Dec. 5, 2018; 17 Pages.

U.S. Notice of Allowance dated May 17, 2019 for U.S. Appl. No. 15/999,435; 11 Pages.

U.S. Corrected Notice of Allowability dated Jun. 4, 2019 for U.S. Appl. No. 15/999,435; 6 Pages.

European Examination Report dated Oct. 24, 2019 for European Application No. 17704854.3; 4 Pages.

| Freq [GHz] | Uniform Applied Field | Disk Magnet Bias | Shaped Magnet Bias | Ideal Bias |
|---|---|---|---|---|
| 1.25 | -7.661323099 | -9.444603675 | -5.088623194 | -2.701428798 |
| 1.375 | -5.850754904 | -7.638030804 | -1.643605485 | -0.865961202 |
| 1.5 | -4.183344987 | -4.438617559 | -0.604724446 | -0.396924733 |
| 1.625 | -2.001630116 | -1.51582425 | -0.352852886 | -0.29929456 |
| 1.75 | -2.213887115 | -0.545827561 | -0.393349303 | -0.425500351 |
| 1.875 | -3.658056838 | -0.450118452 | -0.540008891 | -0.594847688 |
| 2 | -4.780688526 | -0.520678342 | -0.623451233 | -0.670568401 |
| 2.125 | -6.883193941 | -0.568148407 | -0.64333832 | -0.673066595 |
| 2.25 | -6.770339409 | -0.558613409 | -0.616254134 | -0.641130879 |
| 2.375 | -6.289128877 | -0.530909313 | -0.575658046 | -0.591927573 |
| 2.5 | -4.472613373 | -0.491877339 | -0.534313709 | -0.5442289 |
| 2.625 | -3.85902744 | -0.476139594 | -0.498829338 | -0.514744857 |
| 2.75 | -4.441052891 | -0.49078273 | -0.512790331 | -0.52156954 |
| 2.875 | -4.423900129 | -0.543922705 | -0.565245231 | -0.572986059 |
| 3 | -3.803210108 | -0.622072799 | -0.640422535 | -0.653661799 |
| 3.125 | -2.341560394 | -0.67282845 | -0.684582844 | -0.687588192 |
| 3.25 | -1.451652051 | -0.706630834 | -0.714365629 | -0.716069509 |
| 3.375 | -1.147657888 | -0.712418551 | -0.718421813 | -0.720034511 |
| 3.5 | -1.008276269 | -0.699455658 | -0.703100172 | -0.704671726 |
| 3.625 | -0.920135669 | -0.675313376 | -0.675346174 | -0.67583033 |
| 3.75 | -0.856262291 | -0.65015937 | -0.646295006 | -0.644765018 |

To FIG. 7B

*FIG. 7A*

From FIG. 7A

| | | | | |
|---|---|---|---|---|
| 3.875 | -0.817710695 | -0.63853919 | -0.631400139 | -0.627638164 |
| 4 | -0.809926126 | -0.65211545 | -0.642420968 | -0.636457093 |
| 4.125 | -0.834654688 | -0.691943343 | -0.679967617 | -0.671610621 |
| 4.25 | -0.881321248 | -0.746466015 | -0.732240422 | -0.72119681 |
| 4.375 | -0.929446774 | -0.796839629 | -0.780851818 | -0.767268044 |
| 4.5 | -0.959384019 | -0.82731596 | -0.810727288 | -0.795620959 |
| 4.625 | -0.961560058 | -0.831939535 | -0.815869226 | -0.800876375 |
| 4.75 | -0.935885239 | -0.813585043 | -0.798384458 | -0.785116416 |
| 4.875 | -0.893634321 | -0.781352487 | -0.766589447 | -0.756276579 |
| 5 | -0.845191029 | -0.749277227 | -0.734026033 | -0.727247649 |
| 5.125 | -0.812278449 | -0.732525006 | -0.715547711 | -0.711804384 |
| 5.25 | -0.805718684 | -0.740310852 | -0.720228051 | -0.717956385 |
| 5.375 | -0.828433112 | -0.770310449 | -0.745831613 | -0.743137954 |
| 5.5 | -0.867677683 | -0.808523272 | -0.778648135 | -0.74189767 |
| 5.625 | -0.898663143 | -0.831907225 | -0.796359338 | -0.789682126 |
| 5.75 | -0.889456532 | -0.813151911 | -0.774526283 | -0.765826499 |
| 5.875 | -0.829734757 | -0.754078857 | -0.722693098 | -0.71306742 |
| 6 | -0.825424237 | -0.776673032 | -0.773927858 | -0.764533661 |
| 6.125 | -1.258844973 | -1.251628869 | -1.324916924 | -1.302867123 |
| 6.25 | -3.1947147 | -3.192859247 | -3.616964547 | -3.4838282 |
| 6.375 | -9.629293234 | -9.607613557 | -11.28803802 | -10.80389345 |
| 6.5 | -10.47041419 | -9.950105293 | -8.991921038 | -9.297193571 |

*FIG. 7B*

SHAPED MAGNETIC BIAS CIRCULATOR

FIELD

At least some embodiments described herein relate to systems, methods, and apparatuses to shape a magnetic field in a magnet or a magnetic device. More specifically, at least some embodiments described herein relate to systems, methods, and apparatuses that can increase the bandwidth and reduce insertion loss of electrical devices such as circulators, isolators, and duplexers by optimizing and shaping the applied direct current (DC) magnetic bias field of permanent magnetic material used in the electrical device, so as to achieve a substantially uniform internal bias field with a field value ideally just below saturation of the ferrite material used in the device.

CROSS REFERENCE TO RELATED APPLICATIONS

This application is a divisional of and claims the benefit of U.S. patent application Ser. No. 15/999,435, entitled "Shaped Magnetic Bias Circulator," which was filed on Aug. 20, 2018, which is a divisional of and claims the benefit of U.S. patent application Ser. No. 15/062,686, entitled "Shaped Magnetic Bias Circulator," which was filed on Mar. 7, 2016 (now U.S. Pat. No. 10,096,879 which was issued on Oct. 9, 2018), and all of these applications are hereby incorporated by reference.

BACKGROUND

A circulator is an electrical device made using a ferrite loaded symmetrical junction of three or more regularly spaced transmission lines, which device has nonreciprocal operation, preferring progression of electromagnetic fields in one circular direction. Thus, during operation, a circulator has a property of transferring power from its so-called incident port to the next adjacent port and isolating all other ports. Properties that characterize circulator performance include insertion loss, return loss, and isolation (insertion loss in the undesired direction) and band width (frequency range of operation).

FIG. 1A is a functional diagram of a prior art, three-port circulator 100 (also referred to herein as a Y-junction circulator), which is unique, passive, non-reciprocal symmetrical junction device having one typical input port, one output port, and one decoupled port, in which a microwave or radio frequency signal entering any port is transmitted to the next port in rotation (only). The circulator 100 of FIG. 1A provides transmission of energy from one of its ports to an adjacent port, while decoupling the signal from all other ports. The circulator symbol shown in FIG. 1A, for example indicates that the RF energy incident on port 1 emerges from port 2, entering port 2 also be used as an isolator or a switch, and is simple in construction, compact, and, in at least some applications, lightweight. Circulators can be implemented using resonant structures such as radio frequency resonant cavities and in waveguide at higher frequencies. Circulators may also be realized in planar configuration using stripline or microstrip technology which employ a planar resonating element between two ground plane conductors (stripline) or coupled to a single ground plane conductor (microstrip). Examples of microstrip and stripline circulator construction are provided, for example, in U.S. Pat. No. 4,704,588, which is hereby incorporated by reference. Additional examples of stripline circulator construction are provided, for example, in U.S. Pat. No. 3,758,878, which is hereby incorporated by reference.

Additional types of circulators include isolators (a three-port circulator with one port terminated in a matched load) and duplexers (four-port circulators, often used in radar systems and to separate received and transmitted signals in a transmitter). A related type of electrical device is an isolator, which is a two-port device that transmits microwave or radio frequency power in one direction only. Isolators can be used to shield a circuit on its input side, from the effects of conditions on its output side (e.g., an isolator can help prevent a microwave source being detuned by a mismatched load.) A three port circulator can be turned into an isolator by terminating one of its three ports with a matched load.

RF circulators further can divide into the subcategories of 3 or 4-port waveguide circulators based on Faraday rotation of waves propagating in a magnetized material, and 3-port "Y-junction" circulators based on cancellation of waves propagating over two different paths near a magnetized material. The Y-junction circulator can be constructed in either rectangular waveguide or stripline. Waveguide circulators may be of either 4-port or 3-port type, while more compact devices based on striplines generally are of the 3-port type, and are generally used with high microwave frequencies. Stripline circulators are generally used with VHF and low microwave frequencies and often are made using coaxial connectors. In both types of circulators, a ferrite element is placed in the center of three symmetrical junctions that are spaced 120 degrees apart. A ferrite post is used in the waveguide circulator, and two ferrite disks, one located on each side of a metal center conductor, are used in the stripline circulator.

Ferrite stripline circulators also can be referred to in the art as ferrite stripline junction circulators. A stripline junction circulator is a three-port non-reciprocal microwave junction used to connect a single antenna to both a transmitter and a receiver. For example, FIG. 1B is a schematic diagram of a prior art, three port stripline circulator 105. This exemplary three port ferrite stripline circulator 105 of FIG. 1B is made using two planar ferrite disk resonators 120*a*, 120*b*, symmetrically coupled by three transmission lines 130*a*, 130*b*, 130*c* (sometimes referred to as "resonating elements"), formed into a "Y" shape, where the ferrite disks 120*a*, 120*b*, and the intersection of the 3 transmission lines 130*a*, 130*b*, 130*c* from the Y-junction is where the actual circulation occurs. The two ferrite disc resonators 120*a*, 120*b* are spaced between a conducting center plate (e.g., the center conductors 130) and two conducting ground planes (110*a*, 110*b*), and two permanent magnets 112*a*, 112*b*, which provide a magnetic bias to the ferrite disc resonators 120*a*, 120*b*, respectively.

The magnetic bias from the permanent magnets 112*a*, 112*b* helps to achieve power flow in the preferred direction(s). The static biasing magnetic field 140 from permanent magnets 112*a*, 112*b* is oriented perpendicular to the plane in which the junction of transmission lines 130*as*, 130*b*, 130*c* lie, as shown in FIG. 1B. Each of the permanent magnets 112*a*, 112*b* behaves like a respective magnetic pole that helps to orient the magnetic field.

Depending upon particular requirements of the circulator 105, a high permeability spacer (not shown) may be used to focus or spread the magnetic field 140. In addition, as will be understood in the art, one or both of the permanent magnets 112*a*, 112*b* may include a pole piece. A pole piece attaches to and in a sense extends a pole of the magnet 112.

A pole piece (which is not shown in FIG. 1B), is a structure that attaches to the magnet and helps to extend the pole of the magnet by directing the magnetic field produced by a magnet. The pole piece usually is made of high magnetic permeability material.

With ferrite resonator-based circulators, the nonreciprocal characteristics of the ferrite resonator 120, under the influence of proper magnetic bias fields (from the permanent magnets 112), make the aforementioned power transfer possible. One permanent magnet (in a microstrip circulator) or two (in a stripline circulator) provides the required magnetic field to induce the non-reciprocal behavior of the ferrite (gyromagnetic).

Ferrites can be divided into two families based on their magnetic coercivity (their resistance to being demagnetized): hard ferrites (difficult to degmagnetize) and soft ferrites (easy to demagnetize). Circulators typically use soft ferrites and, thus, many circulators require a separate bias magnet (e.g., magnet 112) to apply a bias to the ferrite. This can add bulk and weight to the circulator.

Although FIG. 1B illustrates a prior art stripline circulator, one of skill in the art will appreciate that a microstrip circulator includes some similar components, but instead of having its transmission lines 130*a-c* (which also are collectively referred to as a planar resonating element) disposed between two ground plane conductors 110*a*, 110*b*, two ferrite disks 120*a*, 120*b*, and two biasing magnet 112*a*, 112*bs*, in a microstrip circulator, the transmission lines 130*a-c* can instead be coupled to a single ground plane conductor (microstrip), using a single ferrite biased by a single biasing magnet. Also, although not shown, one will appreciate that at least some prior art circulators are contained in a high permeability housing, which also directs the field of the biasing magnet(s) used.

Referring still to the stripline circulator 105 of FIG. 1B, when one of the ports 130*a*, 130*b*, 130*c* of the stripline circulator 105 is appropriately terminated, with either an internal or external termination, the stripline circulator 105 then becomes an isolator which isolates the incident and reflected signals. Thus, a signal applied to the ferrite disk pair 120*a*, 120*b*, will generate two equal, circularly polarized counter-rotating waves (similar to the arrows shown in FIG. 1A) that will rotate at velocities $\omega+$ and $\omega-$. The velocity of a circularly polarized wave as it propagates through a magnetically biased microwave ferrite material depends on its direction of rotation. By selecting the proper ferrite material and biasing magnetic field, the phase velocity of the wave traveling in one direction can be made greater than the wave traveling in the opposite direction.

For example, referring to FIGS. 1A and 1B, if a signal were applied at Port 1 (e.g., transmission line 130*a*); the two waves will arrive in phase at Port 2 (e.g., transmission line 130*b*) and cancel at Port 3 (e.g., transmission line 130*c*). Maximum power transfer will occur from Port 1 to 2 and minimum transfer from Port 1 to 3, depending on the direction of the applied magnetic field. Due to the symmetry of the Y-Junction, similar results can be obtained for other port combinations. Externally the circulator seem to direct the signal flow clockwise or counterclockwise depending on the polarization of the magnetic biasing field.

FIG. 1C is a schematic diagram of a prior art, three port waveguide circulator 115. Although FIG. 1C shows the waveguide circulator 115 having three H-plane junctions, Electric field-plane (E-plane) circulators can also be made (for clarity, the magnet 112 is not shown in FIG. 1C). Operation in the circulator 115 of FIG. 1C is generally similar to that of FIG. 1B.

SUMMARY

Though ferrite circulators can provide good forward signal circulation while suppressing greatly the reverse circulation, one limitation of ferrite circulators is the generally bulky sizes and the narrow bandwidths that can be associated with their use. For example, a non-uniform magnetic bias limits the bandwidth of microwave stripline and microstrip circulators. For example, referring to FIG. 1B, even though the permanent magnet 112 might, by itself, have a substantially uniform magnetic bias throughout (within a certain predetermined tolerance), when the permanent magnet 112 is operably coupled into the circulator, the resulting magnetic bias that is applied to the ferrite resonator 120 (resulting in an internal magnetic bias in the ferrite resonator 120) can be substantially non-uniform, because of an inherent demagnetization effect resulting from the shape of the ferrite resonator 120. Such circulators, as noted above, can be built using one or more ferrite resonator disks made from a magnetic ferrite substrate material, along with one or two permanent magnets used to bias the ferrite resonator(s) (depending on whether it is stripline or microstrip circulator, as will be understood in the art). To achieve optimum performance, the magnetic ferrite substrate resonator disk of the circulator advantageously can be biased just below saturation (of the ferrite circulator) in the transverse direction of signal propagation with near zero bias in any other direction. This type of bias can be difficult to achieve in practice because the total field in a ferrite disk is a combination of the applied field (from the permanent magnet) and the demagnetizing field based on the disk shape. As noted above, although known permanent magnets with the pole pieces can provide a uniform applied field by themselves, the resultant field (combination of applied field and demagnetizing field) is not uniform, which can result in less than optimum performance and reduced bandwidth.

For example, the demagnetizing factor for a thin ferrite disk is approximately 0.9 near the disk center and approximately 0.4 near the disk edge. The internal magnetic field in a ferrite disk is equal to the applied magnetic field minus the product of the demagnetization factor for the ferrite disk (also referred to as shape factor) and the magnetization. Thus, a uniform applied field (e.g., from a bias magnet made using a permanent magnet having a substantially non-varying magnetization and/or magnet strength) will result in a substantially non-uniform bias field in the disk. If the field strength for a uniform applied bias field is adjusted to just saturate the disk center of a ferrite resonator disk, the periphery of the ferrite resonator disk will have nearly twice the internal field necessary for saturation of the ferrite disk and thus be over-biased resulting in bandwidth reduction.

One solution to this issue of non-uniform magnetic bias has been to place the ferrite resonator disk within a sphere of ferrite material, so that the demagnetizing factor is uniform throughout the sphere and is equal to ⅓. This configuration does result in increased circulator bandwidth. However, in known implementations, the sphere diameter is the same as the disk diameter, which makes the resulting device quite large and not easily integrated with other planar circuitry.

Another approach to attempt to achieve uniform internal magnetic bias and to improve circulator bandwidth is by using an arrangement having multiple magnetic ferrite rings and disks, where the magnetic saturation of the disk differs from that of an adjacent ring. For example, one method usable to increase the bandwidth of a circulator is to form a composite ferrite substrate of different magnetic saturations and use that as the ferrite resonator. That is, the magnetic saturation of the ferrite resonator substrate can be varied radially. The center disk in the ferrite resonator substrate has the highest saturation magnetization. Employing rings of material around the center disk having progressively lower saturation magnetizations reduces formation of magnetostatic surface modes at the ferrite disk to dielectric substrate interface, whose resonant frequencies limit bandwidth. Thus, the use of such composite ferrite substrates lowers the low band frequency of operation, which does help to add to bandwidth. However, maximum obtainable bandwidth of operation is not achieved, as biasing the composite ferrite circulator with constant uniform applied magnetic field across the entire resonator structure over biases the outer ring region (this is illustrated herein via "uniform applied field" data and lines in the graphs and tables of FIGS. 6-8, described further herein) of FIG. 8. An illustrative optimum bias field value in the ferrite is 75 Oersted where the ferrite is 97% magnetically saturated. Also the demagnetizing effect of the thin ferrite disk/ring is not adequately compensated when a constant bias disk magnet is used. When a shaped magnet bias is employed, a bias field is obtained that is close to optimum, especially in the disk region of the ferrite resonator.

Additional approaches to improve circulator bandwidth are possible. For example, a further approach involves varying a spacer thickness between a bias magnet and a ferrite, to perform limited magnetic bias optimization. In accordance with at least one embodiment described herein, the variation in spacer thickness can be combined with shaping the magnetic bias in the permanent magnet, to further improve circulator bandwidth.

One prior art approach for shaping magnetic bias is described in U.S. Pat. No. 7,242,264 B1 (the '264 patent), which is incorporated herein by reference. The '264 patent describes several complex arrangements of stacked magnets and flux condensers. Several of the approaches of the '264 patent are illustrated in FIGS. 2A-2C, which are illustrative exploded views of prior art way of shaping magnetic bias using various arrangements of magnets and condensers, wherein in some of the arrangements the stack of disks have a tapered shape, and in some of the arrangements one or more of the components themselves have a tapered shape. The arrangements of FIGS. 1A-1C of the '264 patent each provide a complex arrangement/packaging of stacked magnets and flux condenser to shape the bias magnetic field. For example, FIG. 2A of the '264 patent shows a technique using a pair of bias permanent magnets 11, 12 and a pair of tapered condenser caps 21, 22. FIG. 2B of the '264 patent shows a technique using a pair of bias permanent magnets 11, 12 and a series of condenser disks having shrinking diameters 23, 24, 25, and 26, 27, 28. FIG. 2C shows shaped bias permanent magnets 13, 14 which can in another example (not shown) be sliced into slices with shrinking diameters, as was done with the condensers of FIG. 2B. As FIGS. 2A-2C and as the '264 patent show, shaping magnetic bias with this arrangement can result in considerable bulk in the resulting device.

One embodiment described herein provides a method to increase the bandwidth of a circulator, without added bulk or complexity in manufacturing, by shaping the bias of permanent magnet used with the circulator by varying the magnetic field strength of the permanent magnet radially. In this approach, when the permanent magnet is coupled into the resulting device to provide a magnetic bias to the ferrite resonator, the resulting bias (i.e., the combination of the applied magnetic field from the permanent magnet having a shaped magnetic bias, and the demagnetizing field that inherently results from resonator shape) is substantially uniform at just below saturation (of the ferrite resonator) in the transverse direction to signal propagation. In another embodiment, a permanent magnet is formed from regions of substantially concentric and coplanar rings of varying areas of magnetic strength formed into an integral or monolithic permanent magnet (e.g., a substantially disk shaped permanent magnet), wherein the magnetic strength in each ring region of the permanent magnet varies from the innermost to outermost ring, such that there is a radially varying axisymmetric magnetic strength across the permanent magnet. Several embodiments herein describe ways to achieve this varying axisymmetric magnetic strength in the permanent magnet. In addition, it will be appreciated that at least some of the bias shaping and variation of magnetic strength, as described herein, is usable for and/or can be adapted to compensate for demagnetizing effects in any device.

For example, for a given permanent magnet, the magnetic strength can be varied radially by creating at least two different regions having two different magnetic strengths, with the center ring region can be configured to have the highest magnetic strength, and with the second (e.g., outer) ring region having lower magnetic strength. The embodiments described herein are not limited to two ring regions with different magnetic strengths, but can, in fact, have multiple different regions. Employing substantially concentric and coplanar ring region around the center ring, each subsequent ring region having progressively lower magnetic strengths, then employing the resulting permanent magnet with appropriate spacer between it and the ferrite resonator to provide a substantially uniform internal field within the ferrite resonator, with a field value ideally just below saturation of the ferrite material.

No known method is known to exist in the art for fabricating a permanent magnet as described in connection with at least some embodiments described herein, e.g., a permanent magnet having varying magnetic strength. Thus, using known techniques with constant strength permanent magnets with this design, bandwidth can be limited. However, as will be described herein, additional ways are described herein to form permanent magnets capable of providing a shaped magnetic bias (e.g., a varying magnetic bias over different regions), especially a radially varying axisymmetric magnetic bias, by selectively and controllably demagnetizing (e.g., reverse magnetizing, also referred to herein as reducing local magnetic field strength) one or more rings or regions of the magnetizable material, thus creating a permanent magnet with radially varying magnetic strength.

The permanent magnet with radially varying magnetic strength also can be achieved during the actual manufacturing of the magnet, as shown with at least some embodiments herein. For example, in one embodiment, a permanent magnet is formed by direct write extrusion of one or more materials having variations in magnetic strength, wherein each region of differing magnetic strength is substantially integrally formed to the next regions of differing magnetic strength, enabling formation, when magnetized, of a permanent magnet with radially varying magnetic strength. Permanent magnets made using this method can be used to help increase bandwidth in circuits such as circulators and other devices that use bias magnets and/or permanent magnets.

In another aspect, embodiments described herein provide various methods and configurations for creating an electronic device such as a circulator, limiter, isolator, or any other device that uses permanent magnets and/or magnetic fields during operation, both with conventional (monolithic) ferrite disk resonators and with composite ferrite disk resonators. The electronic device includes one or more magnetic components (e.g., ferrite resonator disks) that require use of a bias magnet to orient the magnetic domains in a particular direction, wherein the electronic device is configured so that, when the permanent magnet having shaped magnetic bias is operably coupled to bias the magnetic component (e.g., ferrite resonator disk), the overall device has a substantially uniform internal bias field at just below saturation level (of the ferrite), in the transverse direction to signal propagation. Advantageously, in one embodiment, the permanent magnet is configured (e.g., using one or more of the methods described herein) to have a varying, shaped magnetic strength that is selected to compensate for at least some of the demagnetizing effects of the ferrite resonator (e.g., based on the shape of the resonator). In addition, in at least one embodiment, the varying shaped magnetic strength in the permanent magnet, and the resulting substantially uniform internal bias field, enables the device to have improved bandwidth and reduced insertion loss.

Thus, when the magnetic structure having a shaped external bias magnetic field, such as a permanent magnet, is installed into an electronic device (e.g., a circulator, limiter, isolator, etc.) and is used to bias the ferrite resonator on the device, during operation of the electronic device, a shaped magnetic bias exists across the permanent magnet and a substantially uniform internal magnetic bias at just below saturation (of the ferrite resonator) in the transverse direction to signal propagation in the electronic device. In one embodiment, the shaped magnetic bias within the permanent magnet comprises a radially varying axisymmetrically shaped magnetic bias. In one embodiment, for example, the radially varying axisymmetrically shaped magnetic bias is formed into a magnetizable component (such as a permanent magnet) by writing a desired magnetic field shape into the permanent magnet, such as by using a magnetic printer.

In one embodiment, the radially varying axisymmetric magnetic bias is formed by providing a permanent magnet that has been magnetized to a predetermined level (e.g., fully magnetized) and then selectively and/or controllably demagnetizing the permanent magnet to shape the magnetic field within the permanent magnet. For example, during manufacture, the permanent magnet can be put in a magnetizer (or other source of magnetizing force H) to become magnetized to a saturation level of flux density (B) on the magnet's BH (hysteresis curve). When the source of magnetizing force is removed (e.g., H approaches zero), the magnet reaches its point of retentivity on the BH curve, where the retentivity corresponds to the remanence or level of residual magnetism in the permanent magnet. In at least some embodiments described in this application, when reference is made to magnetic saturation and/or maximum magnetic strength of a permanent magnet, it will be appreciated that the "magnetic saturation" and "maximum magnetic strength" terms are intended to refer, in at least one embodiment, to this retentivity point (i.e., the remaining magnetic strength in the magnet that is present after the magnetizing force is removed). In contrast, in at least one embodiment described herein, when reference is made herein to saturation of a ferrite, it will be appreciated that the saturation of a ferrite is intended to refer to the actual saturation point on the BH curve (that is, the maximum magnetic flux possible in the presence of magnetizing force, where the magnetizing force corresponds, in one embodiment, to the bias magnetic field.

For example, in one embodiment, the selective and/or controllable demagnetization is accomplished by application of a predetermined varying thermal field in the radial direction, where the thermal field has a temperature sufficiently close to the Curie temperature to enable at least partial demagnetization of the material.

In another embodiment, a radially varying axisymmetrically shaped magnetic bias is formed in a magnetic structure (e.g., the permanent magnet) by forming the magnetic structure using one or more magnetizable materials that are extruded into a desired shape, wherein certain regions of the structure are configured to be formed from a first portion of magnetizable material having a first magnetic strength (e.g., maximum magnetic strength following magnetization), a second portion of magnetizable material having a second magnetic strength, a third portion of magnetic material having a third magnetic strength, and so forth (if applicable), wherein the first, second, and third magnetic strengths are all different, such that the magnetic bias across the magnetic structure can vary (e.g., be radially varying across a disk shaped magnetic structure) or, in a further embodiment, can be shaped as desired, by the degmagnetizing and/or magnetizing processes described herein.

The desired magnetic field shape can be written to a permanent magnet by applying a predetermined magnetic field to that permanent magnet, where the predetermined magnetic field, in at least one embodiment, is a demagnetizing field (also referred to herein as reverse magnetization), e.g., is substantially opposite to the field already present in the permanent magnet. For example, in one embodiment, the predetermined magnetic field is applied to selectively and/or controllably demagnetize, to a certain predetermined degree, one or more regions or portions of the permanent magnet, so as to create a varying or shaped magnetic field in the permanent magnet, as described herein.

In particular, the shaped magnetic bias is configured, in at least some embodiments, so that the shaped magnetic bias provides an applied magnetic field (e.g., from the permanent magnet in the circulator) that, when combined with demagnetizing effects from the ferrite circulator, it results in a substantially uniform magnetic bias during operation of a device in which the permanent magnet and ferrite circulator both operate. Such a substantially uniform magnetic bias increases the bandwidth of the device (e.g., a circulator) and reduces loss compared to a circulator having a ferrite resonator that is biased using a fully magnetized permanent magnet structure (e.g., permanent magnet with pole pieces and/or with a spacer), which permanent magnet structure (also referred to herein as a magnetic structure) does not have a shaped magnetic bias.

Altering the applied DC magnetic bias field to give the magnetic bias field a radially varying and axisymmetric shape, by the methods such as those described herein (including but not limited to direct magnetic writing, varying thermal fields, and/or variation in magnetic material composition), provides for magnetizing either fully or partially and of selective polarity, one or more small areas of the permanent magnet material and allows, in at least some embodiments, an added degree of freedom to the magnetic circuit design. The designed field shape in the permanent magnet is used, in at least some embodiments, to counteract the demagnetizing field shape of a thin ferrite disk, thus obtaining a uniform internal bias within the ferrite leading to improved circulator bandwidth and reduced insertion loss. In some embodiments, the availability of a magnetic writer capable of magnetizing 20 mil diameter circles to varying magnetization levels, as described herein, helps to make at least some of these embodiments readily achievable.

In one embodiment, a circulator is provided, comprising a permanent magnet and first, second and third conductors forming three equally spaced junctions. The permanent magnet in operable communication with the first second and third conductors and configured to apply a shaped bias magnetic field to a ferrite resonator in operable communication with the first, second, and third conductors, the permanent magnet comprising a substantially planar and monolithic structure having at least first and second substantially concentric regions defined thereon, the first region comprising an inner concentric region having a first magnetic field strength level and the second region comprising an outer concentric region having a second magnetic field strength level, wherein the first magnetic field strength level is higher than the second level, and wherein the first and second magnetic field strength levels are configured to cooperate to shape an external bias magnetic field of the permanent magnet to counteract at least a portion of a demagnetizing effect resulting from of an overall shape of the ferrite resonator, so as to achieve a substantially uniform internal magnetic bias within at least a portion of the ferrite resonator.

In one embodiment, the shaped bias magnetic field of the permanent magnet radially varies, wherein the bias magnetic field comprises a center region and an edge region and wherein the shaped bias magnetic field is configured to be higher at its center region than at its edge region. In one embodiment, the shaped magnetic bias field comprises a radially varying axisymmetric magnetic bias. In one embodiment, the ferrite resonator comprises a composite structure that comprises at least first and second concentric and coplanar ferrite materials, the first ferrite material having a different magnetic saturation than the second magnetic material.

In one embodiment, the ferrite resonator comprises a plurality of coplanar and concentric ferrite rings, each respective ferrite ring having a different respective magnetic saturation, wherein, within the plurality of ferrite rings, an innermost ferrite ring has the highest magnetic saturation and an outmost ferrite ring has the lowest magnetic saturation; and a magnetic bias of the permanent magnet varies radially within the permanent magnet, having a highest magnetic intensity at a center of the permanent magnet and a lowest magnetic intensity at an edge of the permanent magnet. In one embodiment, at least one of the magnetic saturation of the ferrite resonator and the magnetic bias of the permanent magnet are configured to ensure that the internal magnetic field in the ferrite resonator is substantially uniform. In one embodiment, at least one of the magnetic saturation of the ferrite resonator and the magnetic bias of the permanent magnet are configured to maximize circulator bandwidth. In one embodiment, at least one of the magnetic saturation of the ferrite resonator and the magnetic bias of the permanent magnet are configured to minimize circulator insertion loss.

In one embodiment, a circulator is provided that comprises first, second and third conductors forming three equally spaced junctions; and a hexaferrite resonator in operable communication with the first, second and third conductors, the hexaferrite resonator comprising a structure having defined thereon at least first and second substantially concentric regions, the first region comprising an inner concentric region having a first magnetic saturation level and corresponding first magnetic field strength and the second region comprising an outer concentric region having a second magnetic saturation level and corresponding second magnetic field strength, wherein the first magnetic saturation level and first field strength are both higher than the second magnetic saturation level and second magnetic field strength, respectively, and wherein the first and second magnetic saturation levels and first and second magnetic field strengths are configured to cooperate to shape the internal magnetic field of the hexaferrite resonator in a manner that ensures that the internal magnetic field of the hexaferrite resonator is substantially uniform.

In one embodiment, the shape of the internal magnetic field of the hexaferrite resonator is configured to counteract at least a portion of a demagnetizing effect resulting from of an overall shape of the hexaferrite resonator, so as to achieve a substantially uniform internal magnetic bias within at least a portion of the hexaferrite resonator. In one embodiment, the shaped internal magnetic field of the hexaferrite resonator radially varies, wherein the shaped internal magnetic field comprises a center region and an edge region and wherein the shaped internal magnetic field is configured to be higher at its center region than at its edge region.

In one embodiment, a method is provided for making a magnetic structure having a shaped external magnetic bias field. The method comprises:

providing a magnetic structure comprising a permanent magnetic material, the magnetic structure comprising at least a first region and a second region that have each been magnetized to a predetermined retentivity point, the first and second regions being substantially coplanar and concentric, wherein the first region comprises an inner concentric region and the second region comprises an outer concentric region; and controllably reducing local magnetic field strength of at least a portion of at least one of the first and second regions to shape an external magnetic bias created by the first and second regions of the magnetic structure, wherein a resultant shaped external magnetic bias is configured to counteract at least a portion of a demagnetizing effect resulting at least in part from a shape of an external structure biased by the magnetic structure.

In one embodiment, the method further comprises controllably reducing magnetic field strength of at least a portion of at least one of the first and second regions to create a radially varying axisymmetric magnetic bias in the magnetic structure. In one embodiment, the method further comprises configuring a distance between the magnetic structure and the external structure biased by the magnetic structure to shape the external magnetic bias. In one embodiment, the magnetic structure further comprises at least one of a spacer and a pole piece, and further comprising configuring a size of the at least one of a spacer and the pole piece to shape the external magnetic bias. In one embodiment, the magnetic structure comprises a permanent magnet and wherein the external structure comprises a resonator of a circulator, wherein the permanent magnet is configured to supply a bias magnetic field to the resonator. In one embodiment, the method further comprises configuring the shape of the bias magnetic field provided by the magnetic structure so that the resonator has a substantially uniform internal magnetic bias field.

In a further embodiment, the method further comprises applying a varying thermal field in a radial direction to at least one of the first and second regions of the magnetic structure to achieve at least partial demagnetization where the varying thermal field is applied, wherein the varying thermal field has a temperature that sufficient to alter the magnetization in a respective region where it is applied, wherein the temperature of the varying thermal field is below a Curie temperature of the magnetizable material in the respective region where the heat is applied. In one embodiment, the method further comprises using a laser to apply at least a portion of the varying thermal field.

In one embodiment, the method further comprises applying a controllable magnetic field to at least a portion of the first and second regions, the controllable magnetic field having a size and polarity configured to selectively reduce the local magnetic field strength of at least a portion of the first and second regions, such that the at least a portion comprises a demagnetized portion, where the magnetic field strength in the demagnetized portion of the first and second regions and the magnetic field strength in a remaining portion of the first and second regions cooperate to shape the external magnetic bias field in the structure. In one embodiment, the magnetic field is applied via a magnetic printing process.

In another embodiment, a method of making a magnetic structure having a shaped external magnetic bias field is provided. The method comprises providing a first material comprising a first concentration of magnetic material;

providing a second material comprising a second concentration of magnetic material, the second concentration being lower than the first concentration; and extruding a varying mix of the first and second materials using a direct write extrusion process to create a substantially planar structure having substantially concentric and coplanar regions with a gradient of concentration of magnetic material, the gradient oriented in a radial direction from the center radially towards and outside edge of the substantially planar structure;

magnetizing the substantially planar structure such that, when magnetized, the substantially planar structure is configured to provide a shaped external bias magnetic field, the shaped external magnetic field configured to counteract at least a portion of a demagnetizing effect resulting at least in part from a shape of at least one of the magnetic structure and an external structure biased by the magnetic structure.

In one embodiment, the method further comprises:

providing first, second and third conductors forming three equally spaced junctions;

operably coupling a ferrite resonator to the first, second and third conductors; and configuring the magnetic structure to apply the shaped magnetic bias field to bias the ferrite resonator, wherein the shaped magnetic bias field helps to counteract at least a portion of a demagnetizing effect arising from a shape of the ferrite resonator, and to achieve a substantially uniform internal magnetic bias within at least a portion of the ferrite resonator; and configuring the first, second, and third conductors, the ferrite resonator, and the magnetic structure to operate as a circulator.

In one embodiment, the method further comprises comprising configuring at least one of a magnetic saturation of the ferrite resonator and the magnetic bias of the magnetic structure to maximize circulator bandwidth. In one embodiment, the method further comprises configuring at least one of a magnetic saturation of the ferrite resonator and the magnetic bias of the magnetic structure to minimize circulator insertion loss.

Details relating to these and other embodiments are described more fully herein.

BRIEF DESCRIPTION OF THE DRAWINGS

The advantages and aspects of the described embodiments will be more fully understood in conjunction with the following detailed description and accompanying drawings, in which:

FIGS. 7A and 7B are top and bottom halves, respectively of an exemplary table showing simulated insertion loss a shaped magnet versus a disk magnet, over a range of frequencies, in various configurations, in accordance with one embodiment;

The drawings are not to scale, emphasis instead being on illustrating the principles and features of the disclosed embodiments. In addition, in the drawings, like reference numbers indicate like elements.

DETAILED DESCRIPTION

Figure 1A:
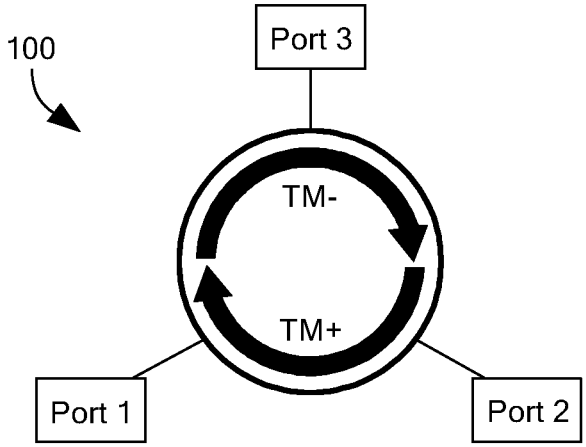
FIG. 1A PRIOR ART
FIG. 1A is a functional diagram of a prior art, three-port circulator.

At least some embodiments described herein are usable to increase the bandwidth of any electrical or electronic devices that use magnets or ferrites, including but not limited to circulators, isolators, and limiters, by shaping the external bias magnetic field in a permanent magnet used to apply a magnetic bias field to the ferrite resonator of a ferrite circulator device. At least some of the methods described herein create a direct current (DC) bias magnet having a shaped magnetic bias, which helps to optimize the D.C. bias applied based on the varying magnetic saturation of the ferrite material and counteract at least some of the effects resulting from the demagnetizing field shape of a device such as a thin ferrite disk, thus achieving an electronic device, such as a circulator, having a substantially uniform internal bias, especially during operation. The permanent magnets with shaped magnetic bias are usable with both composite ferrite resonators and with monolithic ferrite resonators (i.e., ferrite resonators made from a single piece of material, e.g., made from a single block of ferrite material (thus having no substantial variation in magnetic saturation from one part of the ferrite disk to the other, beyond normal tolerance variations, e.g., 3-10% variations.) In addition, it will be appreciated that at least one of the embodiments described herein is usable for and/or can be adapted to compensate for at least some of the demagnetizing effects in any device.

In circulators implemented in accordance with at least some embodiments described herein, a ferrite disc resonator with disc having higher magnetic saturation and a ring of lower magnetic saturation is used. This configuration can help increase bandwidth and reduce insertion loss in the device as well as in components (e.g., circulators, limiters, and isolator) that use the magnetized structure (e.g., the permanent magnet). Furthermore, the customization of the external bias magnetic field shape that is possible with the disclosed methods and devices enables creation of devices having more uniform internal bias and, thus, improved bandwidth.

Those of skill in the art will appreciate that the shaping of the external bias magnetic field provided by the permanent magnet has application in many other devices, systems, and apparatuses, and that the discussion herein in connection with circulators is illustrative and not limiting. In addition, although the discussion in this section is written mostly using the examples of so-called stripline and microstrip circulators, one of skill in the art will appreciate that the systems, methods, and devices described herein have equal applicability in connection with at least waveguide circulators as well. Furthermore, although the discussion herein primarily mentions shaping magnetic bias in permanent magnets used to bias ferrite resonators, it will be appreciated that the descriptions herein are likewise applicable to other magnetizable materials and types of magnets. In addition, although the discussion herein uses examples of biasing of the so-called spinel types of ferrites, it will be appreciated that the embodiments herein also are applicable to other ferrite families, including but not limited to garnets and hexagonal ferrites. In particular, at least some embodiments described herein are applicable to materials including but not limited to non-conductive ferrimagnetic ceramic compounds derived from iron oxides such as hematite ($Fe_2O_3$), magnetite ($Fe_3O_4$), oxides of other metals other than iron, YIG (yttrium iron garnet), cubic ferrites composed of iron oxides and other elements such as aluminum, cobalt, nickel, manganese and zinc, and hexagonal ferrites such as $PbFe_{12}O_{19}$ and $BaFe_{12}O_{19}$, and pyrrhotite, $Fe_{1-x}S$.

In a first embodiment, the systems, methods, and apparatus described herein provide a way to increase the bandwidth of a circulator at low frequency band edge by shaping the external bias magnetic field applied to the ferrite resonator of the circulator, by directly shaping the bias field applied by the permanent magnet. A shaped external magnetic bias magnet is produced, e.g., with the magnetic writing device described herein. In further aspects, other types of correlated and/or programmable magnets are usable to help create a shaped external bias magnet. In still further embodiments, additional techniques, methods, apparatuses, and devices (e.g., application of a varying temperature field) are provided to create a shaped external bias magnet.

In at least some embodiments, the shaping of the external bias magnetic field provided by the bias magnet renders the internal magnetic field in the circulator to be substantially uniform in the ferrite disk resonator enhances the circulator operational bandwidth. For example, in one disclosed embodiment, the bias magnet with shaped magnetic field is formed using a magnetic printer such as the CMR MagPrinter (described elsewhere herein; also referred to as a magwriter). The CMR MagPrinter is capable of producing custom bias magnetic field that, in at least some embodiments, enhances the bandwidth even beyond a simulated confirmation of the effect.

In at least one embodiment, a radially varying axisymmetrically shaped magnetic bias, formed by directly writing the desired magnetic field shape into a permanent magnet material, results in the permanent magnet material providing a shaped magnetic bias that is applied to a single ferrite substrate disk or even to composite ferrite substrate disk/ring(s). When assembled into a structure such as a circulator, this forms a device having a nearly uniform internal bias field at just below saturation in the ferrite in the transverse direction to signal propagation including composite ferrite substrate disk/ring(s). The result of this uniform bias is an increase in the bandwidth of the device (e.g., circulator) constructed using this magnet, compared to a circulator biased using a fully magnetized permanent magnet (with no shaped magnetic strength and providing no shaped magnetic field) alone.

Figure 3A:
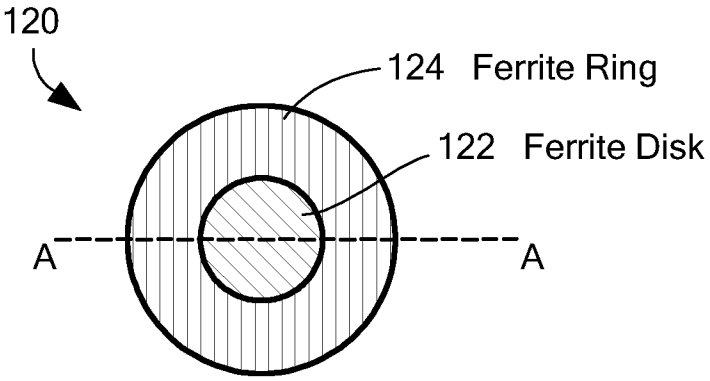
FIG. 3A is an exemplary top view of a first composite ferrite resonator usable with at least the circulators of FIGS. 4A-4H and the methods of FIGS. 11 and 12, in accordance with one embodiment.
Figure 3B:
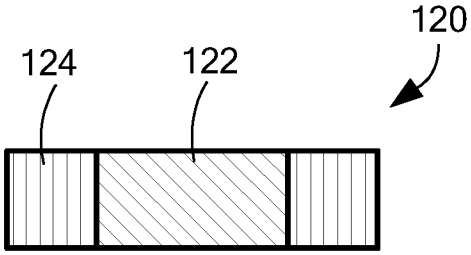
FIG. 3B is a cross-sectional illustration of the first composite ferrite resonator of FIG. 3A, taken along the A-A line.
Figure 9:
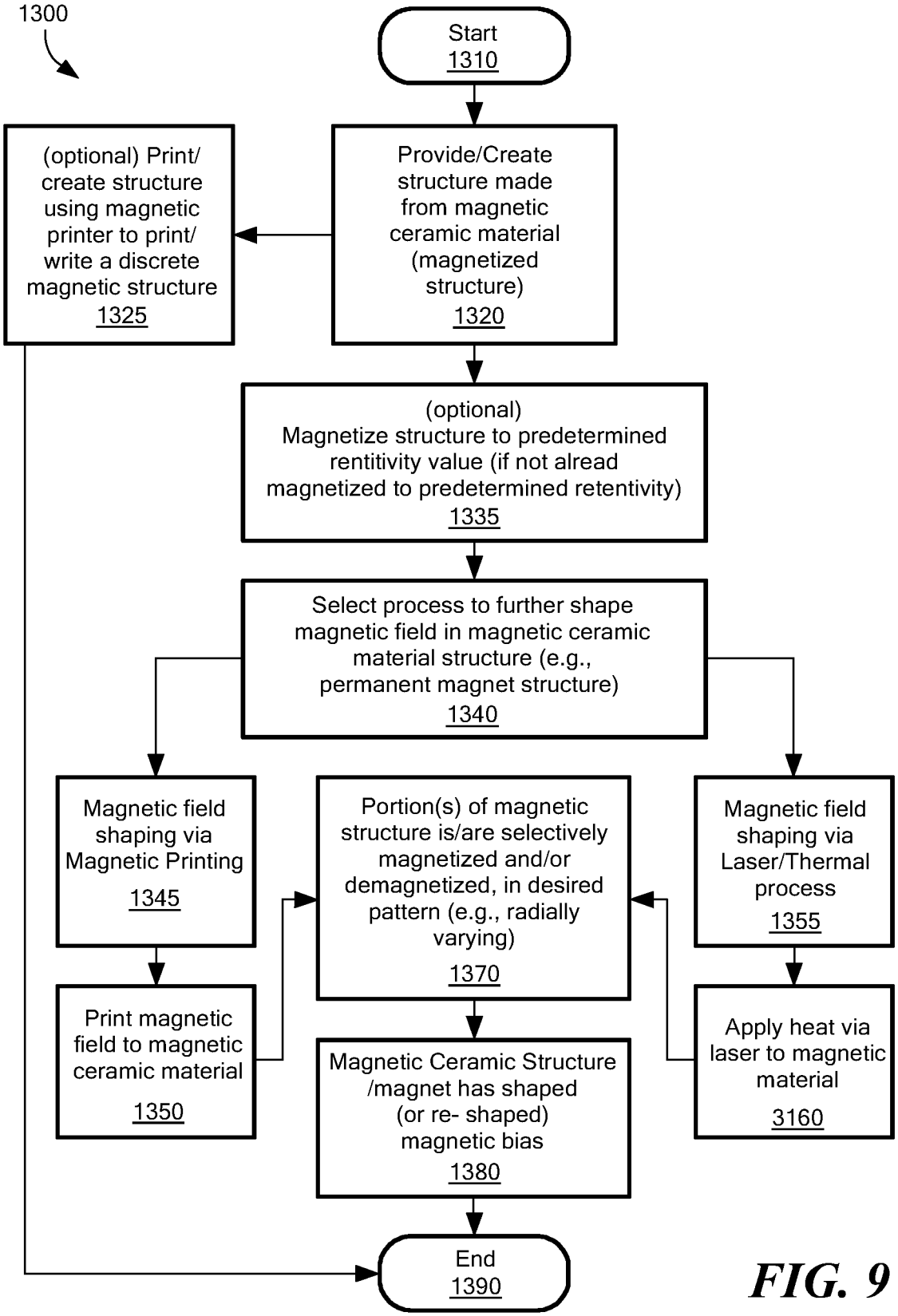
FIG. 9 is a first flow chart showing several methods for creating a magnetic structure having a shaped magnetic bias, in accordance with one embodiment.
Figure 10:
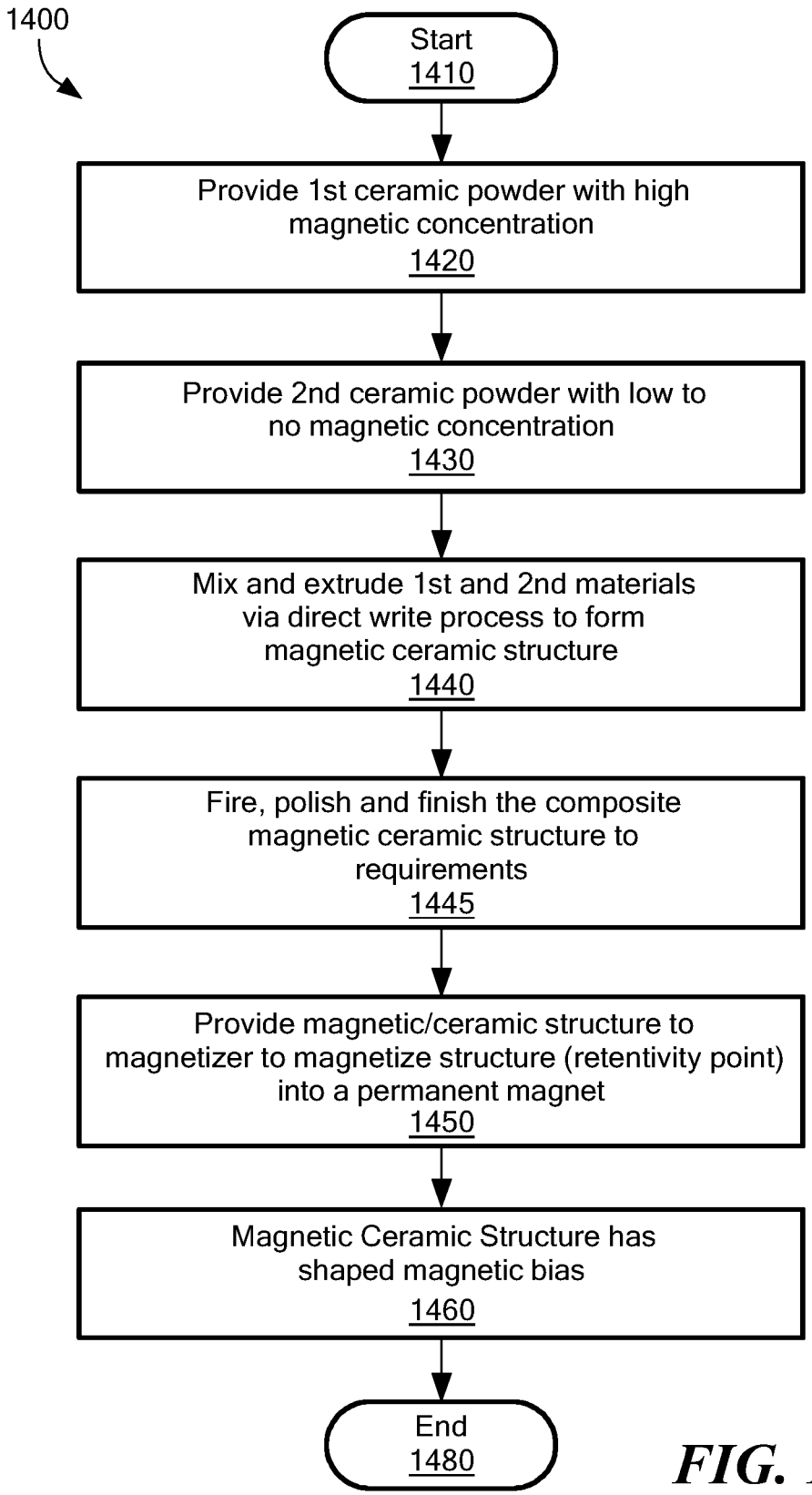
FIG. 10 is a second flow chart showing a method creating a permanent magnet having a shaped magnetic bias, in accordance with one embodiment.

FIG. 3A is an exemplary top view of a first composite ferrite resonator 120 usable with at least the circulators of FIGS. 4A-4H and the methods of FIGS. 9 and 10, in accordance with one embodiment, and FIG. 3B is a cross-sectional illustration of the composite ferrite resonator 120 of FIG. 3A, taken along the A-A line. Referring to FIGS. 3A and 3B, the composite ferrite resonator 120 includes a ferrite disk 122 having a first magnetic saturation and a ferrite ring 124 having a second magnetic saturation, wherein the first magnetic saturation (i.e., near the center) is higher than the second magnetic saturation. The composite ferrite resonator 120 can be made, in one embodiment, using two different ferrite materials, each having a different magnetic saturation level, or can be formed using a single type of ferrite material, where different regions have different magnetic saturation levels.

Figure 3C:
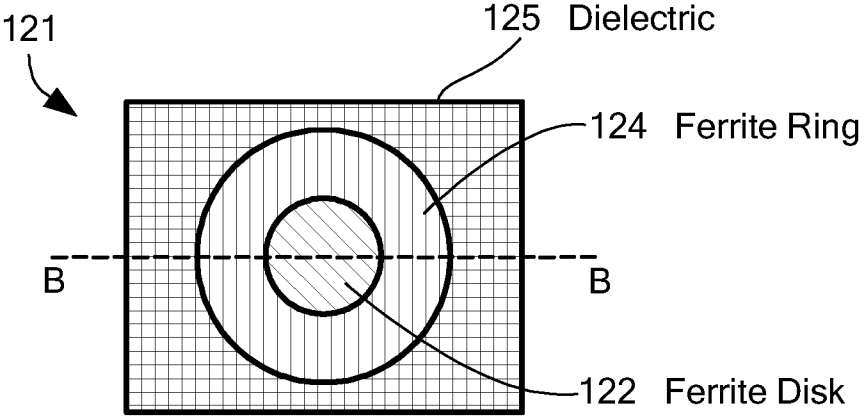
FIG. 3C is an exemplary top view of a second composite ferrite resonator embedded within a dielectric substrate, usable with at least the circulators of FIGS. 4A-4H and the methods of FIGS. 11 and 12, in accordance with one embodiment.
Figure 3D:
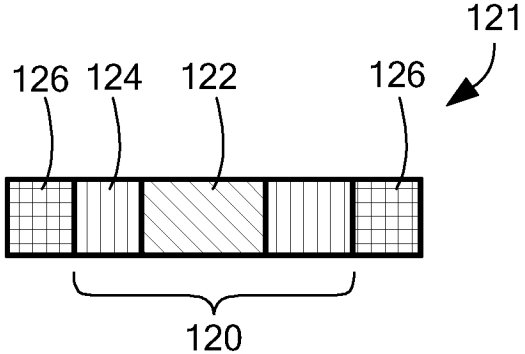
FIG. 3D is a cross-sectional illustration of the second composite ferrite resonator of FIG. 3C, taken along the B-B line.

FIG. 3C is an exemplary top view of a second composite ferrite resonator 125 embedded within a dielectric substrate 125 usable with at least the circulators of FIGS. 4A-4H and the methods of FIGS. 9 and 10, in accordance with one embodiment, and FIG. 3D is a cross-sectional illustration of the second composite ferrite resonator of FIG. 3C, taken along the B-B line. The composite ferrite resonator 125 of FIGS. 3C-3C is similar to that of FIG. 3A-3B, but is embedded, as shown in FIG. 3D, within a dielectric material. This configuration can be advantageous in circulators where small size is important, such as with microstrip circulators (e.g., as in FIG. 4C, described further herein).

Figure 4A:
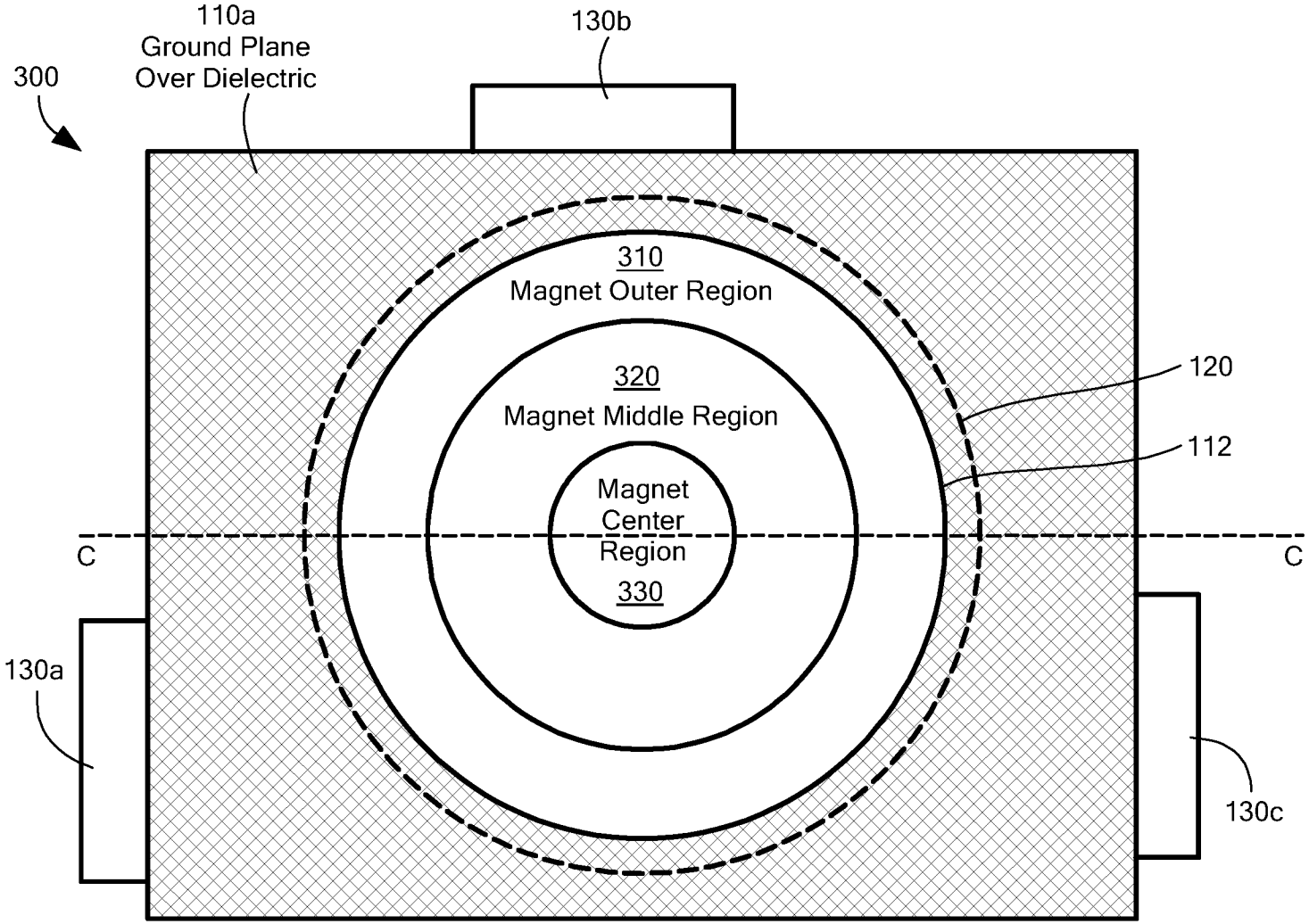
FIG. 4A is an exemplary top view of a portion of a stripline circulator that includes an integral ferrite and permanent magnet configured to have a shaped magnetic bias, showing a variation of magnetic strength in a radial direction, in accordance with one embodiment.
Figure 4B:
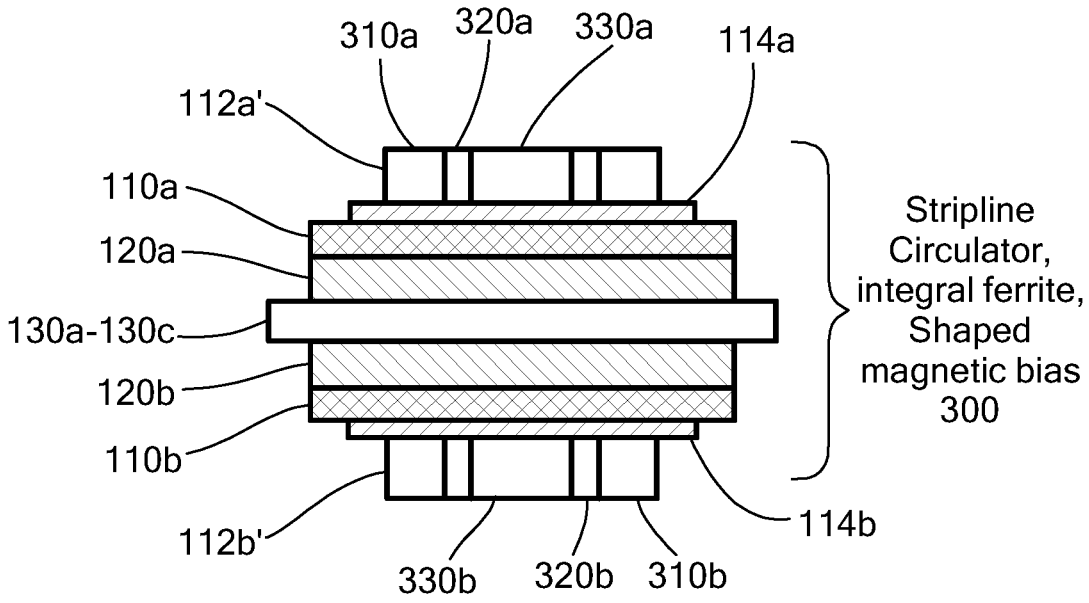
FIG. 4B is an exemplary cross-sectional view of the stripline circulator of FIG. 4A, taken along the C-C line.

FIG. 4A is an exemplary top view of a stripline circulator 300 that includes an integral ferrite 120, permanent magnet 112, and pole piece 114 (pole piece not visible in FIG. 4A) configured to have a shaped magnetic bias, showing a variation of magnetic strength in a radial direction, in accordance with one embodiment. FIG. 4B is an exemplary cross-sectional view of the stripline circulator 300 of FIG. 4A, taken along the C-C line. FIG. 4D is a partial cross-sectional view of the circulator 300 of FIG. 4A, taken along the A-A line.

Figure 1B:
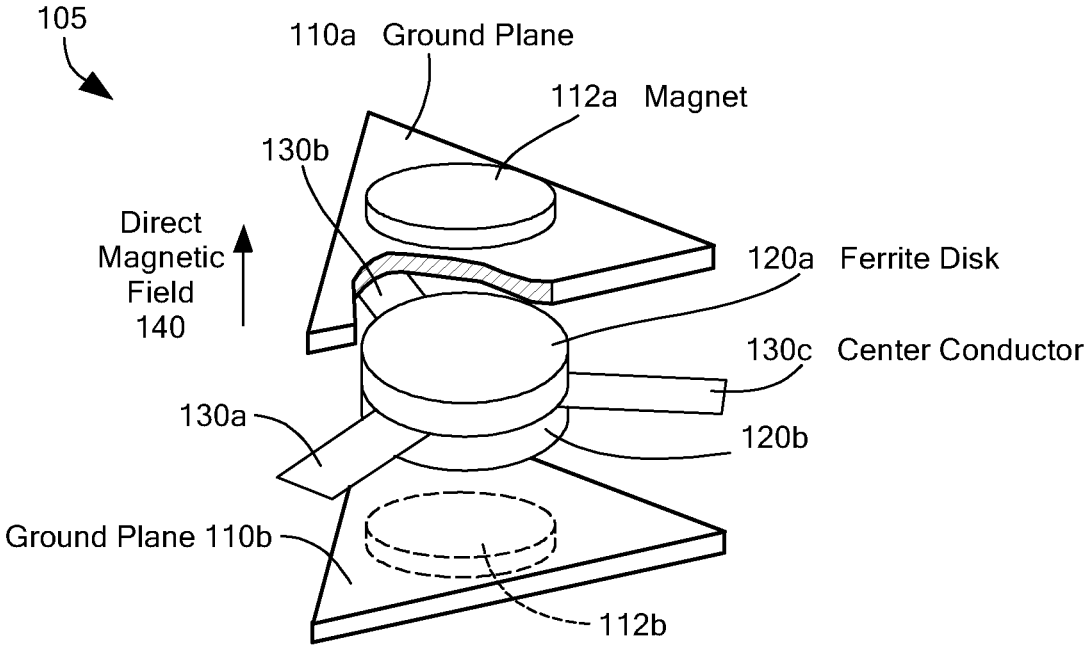
FIG. 1B PRIOR ART
FIG. 1B is a schematic diagram of a prior art, three port stripline circulator.
Figure 1C:
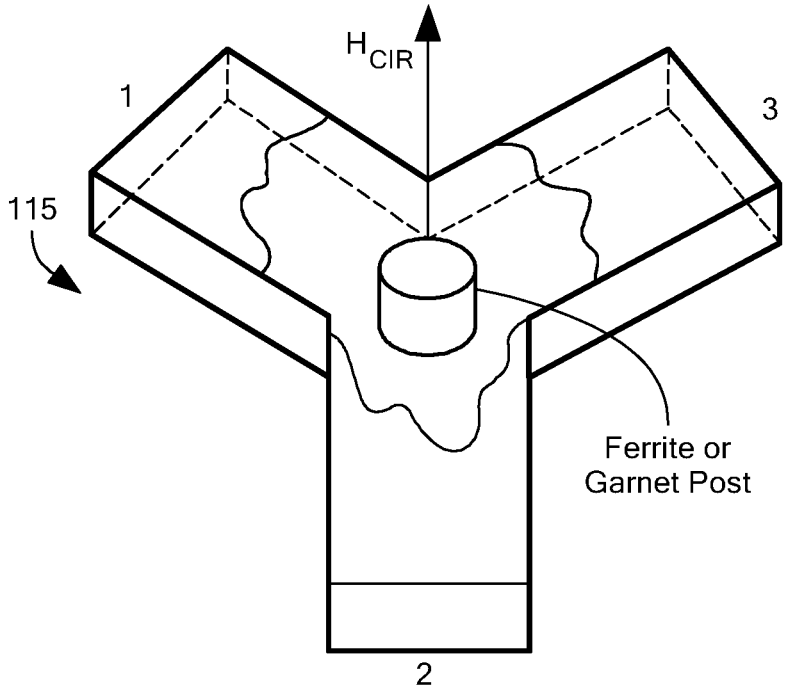
FIG. 1C PRIOR ART
FIG. 1C is a schematic diagram of a prior art, three port waveguide circulator.
Figure 2B:
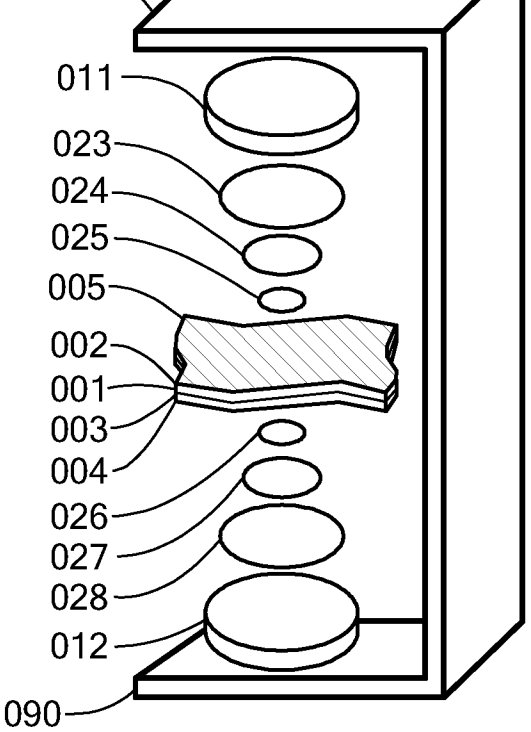
FIG. 2B PRIOR ART
FIGS. 2A-2C are illustrative exploded views of prior art way of shaping magnetic bias.
Figure 2A:
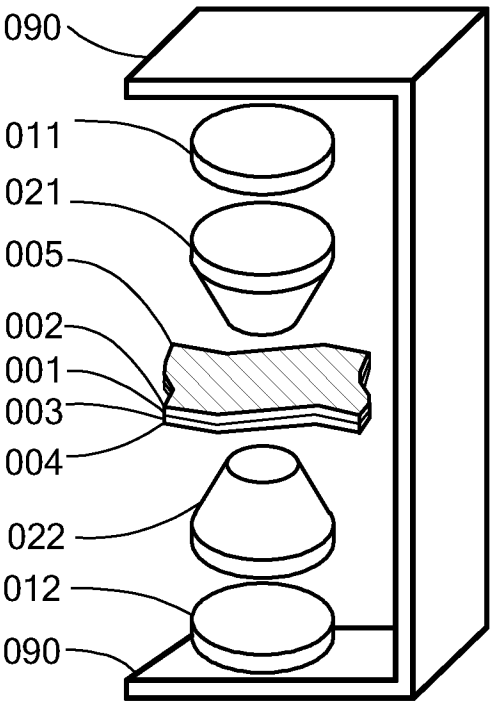
FIG. 2A PRIOR ART
Figure 2C:
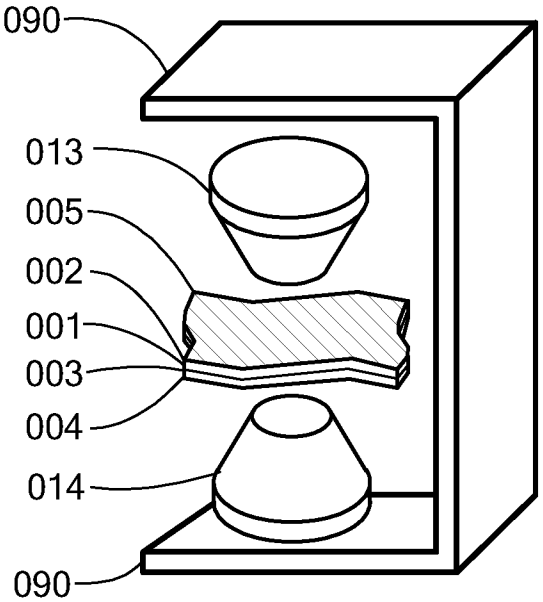
FIG. 2C PRIOR ART

Referring to FIGS. 4A-B and 4D, the stripline circulator 300, 303 includes an arrangement generally similar to that of FIG. 1B, but replacing in these exemplary embodiments, the magnets 112*a*, 112*b* of FIG. 1B, which have a substantially non-varying magnetic bias, with a magnet 112', having a shaped magnetic bias, as described herein. The stripline circulator 300 of FIG. 4B has integral/monolithic ferrite resonators 120*a*, 120*b* (i.e., the ferrite resonators 120*a*, 120*b* are made from a single piece of material instead of a composite) and also includes a pair of high permeability pole pieces 114*a*, 114*a*, disposed between the magnets 112*a*', 112*b*', respectively, and the ground planes 110*a*, 110*b*, respectively. The pole pieces 114*a*, 114*b* help to achieve a substantially uniform bias field. The stripline circulator 303 of FIG. 4D is similar to that of FIG. 4B, but instead uses a composite magnetic ferrite similar to that of FIGS. 3A-3B.

Figure 4C:
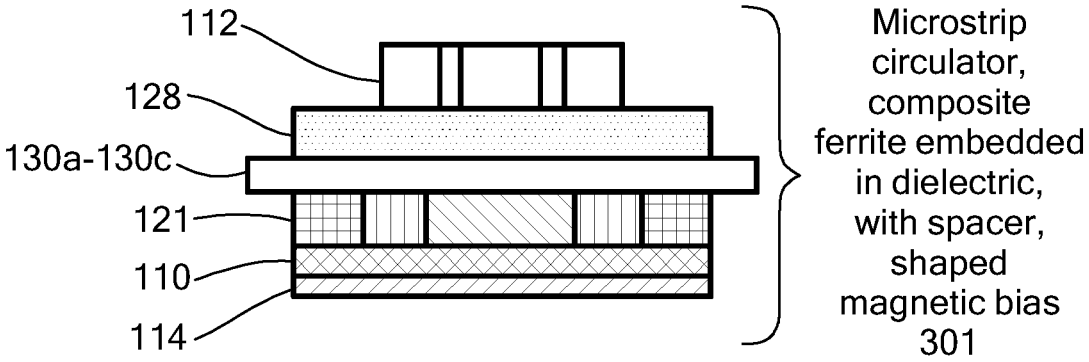
FIG. 4C is an exemplary cross-section view of a microstrip circulator, with the composite ferrite resonator of FIG. 3C, shaped magnetic bias permanent magnet, and a spacer, in accordance with one embodiment.
Figure 4D:
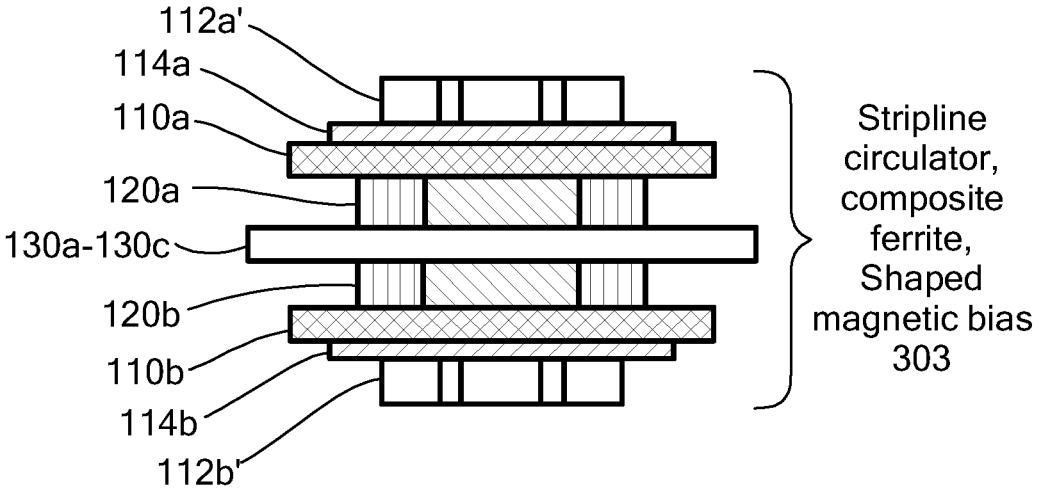
FIG. 4D is an exemplary cross-section view of a stripline circulator, with a composite ferrite resonator, and shaped magnetic bias, in accordance with one embodiment.

FIG. 4C is an exemplary cross-section view of a microstrip circulator 301, with the composite ferrite resonator 121 of FIG. 3C, shaped magnetic bias permanent magnet 112, a pole piece 114, a spacer 128, and ground plane 110, in accordance with one embodiment. In this embodiment, the pole piece 114 is disposed adjacent to the ground plane 110, opposite to the side of the composite ferrite resonator 121. As will be understood in the art, the spacer advantageously is made from a material selected for the application and, based on its size and/or configuration optionally can be used to further shape, spread, or focus the bias magnetic field provided by the permanent magnet 112 (e.g., to spread the field). It will be understood that although the embodiment of FIG. 4C is the only embodiment shown that illustrates use of a spacer 128, none of the embodiments are so limited.

It is understood that the top view of the circulator 300 of FIG. 4A does not illustrate, in this view, components disposed beneath the ground plane 110*a*, including the ferrite disks 120 and the remaining portions of the conductors 130*a*-130*c*, but these should be apparent to one of skill in the art, and are shown in the illustrative examples in FIGS. 4B and 4D. The stripline circulator 300/303 of FIGS. 4A-4B and 4D includes conductors 130*a*-130*c* sandwiched between a pair of ferrite resonators 120*a*, 120*b*, a pair of ground planes 110*a*, 110*b*, and a pair of bias permanent magnets 112*a*', 112*b*'. Each respective bias permanent magnet 112*a*', 112*b*' is configured, as described herein, to have a shaped magnetic bias field configured to ensure that, when combined with the demagnetizing effect of due to the shape of the ferrite disk resonators 120*a*, 120*b*, helps to ensure a substantially uniform internal magnetic bias field at just below saturation of the ferrite disk in the transverse direction to signal propagation.

The ferrite resonators 120*a*, 120*b*, are, in FIG. 4B, ferrite substrate disks (i.e. disks made of a ferrite material having a substantially constant magnetic saturation). In FIG. 4D, at least one of the ferrite resonators 120*a*, 120*b* is a composite ferrite structure 120 (e.g., as shown in FIG. 3A), comprising substantially concentric and coplanar materials (e.g., ferrite disk 122 and ferrite ring 124) joined together as an inner disk and an outer ring. The inner disk 122 has a higher magnetic saturation and the outer ring 124 has a lower magnetic saturation, such that the magnetic saturation of the ferrite substrate that forms the composite ferrite resonator has a varying magnetic saturation.

The pair of permanent magnets 112*a*', 112*b*' each include an outer ring region 310 at a relatively low magnetic strength (i.e., having a low magnetic strength when fully magnetized and then selectively and controllably demagnetized), an inner ring region 330 at a relatively high magnetic strength, and a middle ring region 320 having a magnetic strength in between that of the outer ring region 310 and the inner ring region 330, thereby shaping the magnetic bias in each permanent magnet 112' and resulting in, in this example, a radially varying axisymmetric magnetic bias. As FIGS. 4A-4D illustrate, the monolithic arrangement of the regions of rings 310, 320, 330 is substantially coplanar and concentric, and is formed from a single monolithic, integral piece of permanent magnet material, to form a magnetic structure (e.g., a permanent magnet). It will be appreciated that this particular arrangement and variation of magnetic strength to shape the magnetic bias field is illustrative and not limiting. For example, there could be as few as two regions and many more than three different regions of magnetic strength, depending on the application. Advantageously, however, in at least one embodiment, the rings 310, 320, 330 are configured (as described further herein) to have a higher magnetic strength towards the center, and a lower magnetic strength towards the outer edge of the ring 320. As explained further herein, one way of creating this shaped magnetic bias, in accordance with at least some embodiments described herein, is by starting with a substantially fully magnetized permanent magnet (e.g., a magnet that was magnetized to a degree sufficient to reach its maximum retentivity point after the magnetic force is removed) and then selectively and/or controllably demagnetizing one or more regions of the permanent magnet.

Prior art permanent magnets 112*a*, 112*b* (e.g., as shown in FIG. 1B) generally are magnetized to have, by themselves, a uniform and substantially non-varying bias from center to edge.

Substantially non-varying or substantially uniform, in this application, at least means consistent within some predetermined allowable tolerance in the art, where the tolerance will depend on the application. For example, it will be appreciated that natural variations exist even in fully magnetized permanent magnets which are supposed to have a substantially uniform magnetic bias. Thus, there may be some small tolerance (e.g., +/−3-7%) in the uniformity of magnetization in a fully magnetized permanent magnet. However, this "natural" variation in the uniformity tolerance is not controllable or predictable and thus cannot be considered to be deliberately shaped, in contrast to the substantially controlled and predictable shaped magnetic bias being that is described in connection with the embodiments herein.

In FIGS. 4A and 4D, the permanent magnets 112*a*', 112*b*' are each operably coupled to a respective ground plane 110 (formed using an area of metallization disposed over a substrate material such as a dielectric or ferrite substrate material) and configured to provide a shaped magnetic bias to the ferrite resonators 120*a*, 120*b*, respectively, wherein the shaped magnetic bias of these permanent magnets 112*a*, 112*b* (also referred to as bias magnets) is configured to at least partially overcome and/or compensate for the demagnetizing effects inherent in the ferrite resonators 120*a*, 120*b*, such that the net result is a substantially uniform internal magnetic bias field being applied to the ferrite resonators 120*a*, 120*b*. When a ferrite resonator (e.g., a composite ferrite disc and ring or an integral ferrite with varying magnetic saturations) is deployed in a circulator, the magnetic field shaping of the bias magnet (1) 112 provides an optimal internal magnetic field in the ferrite resonator (e.g., in the disc and ring regions) increasing the band width and reducing the insertion loss in devices in which they are installed, including but not limited to circulators.

As will be appreciated, the stripline circulators FIGS. 4B, 4D are generally similar to the stackup of FIG. 1B, but using the permanent magnets having a shaped magnetic bias instead of conventional permanent magnets that do not have a shaped magnetic bias. This forms an article of manufacture (e.g., circulator 300) having nearly uniform internal bias field at just below saturation of the ferrite in the transverse direction to signal propagation. As shown in FIG. 4C, this configuration is equally adaptable to microstrip circulators made using a permanent magnet 112 having a shaped magnetic bias.

In at least one embodiment, as shown in FIGS. 4A-4D, the top sides and/or bottom sides of the ring regions 310, 320, 330 that form the differing areas of magnetic strength on the permanent magnets 112' are, in one embodiment, substantially coplanar and concentric. In one embodiment, the rings 310-330 correspond to differing regions of magnetic strength that are controllable formed by selectively demagnetizing (i.e., reversing the magnetic field) a fully magnetized permanent magnet. Advantageously, in one embodiment, the magnetic strength in each respective ring region 310-320 varies, in a predetermined desired pattern, where the permanent magnet 112 is formed from a single, integral, monolithic piece of permanent magnet material. In a circulator 300 formed as shown in FIGS. 4A-4D and FIG. 5, the external magnetic field varies radially, to make the internal field constant.

In one embodiment, using the permanent magnet 112' with shaped magnetic bias, which results in uniform internal magnetic bias, as part of a device such as a circulator 300, results in an increase in the bandwidth of the resulting device (e.g., circulator) compared to a device biased using a conventional permanent magnet, with no shaped magnetic bias. As noted above, a uniform internal magnetic field helps to improve the circulator band width and reduce insertion loss. The shaped magnetic field helps to compensate for at least some of the demagnetization effects that can result from a demagnetizing field of a relatively thin ferrite disk resonator 120 (and/or composite ferrite disk resonator), to provide optimum magnetic bias in disc/ring composite ferrite substrate.

In accordance with various embodiments described herein and as explained more fully herein, especially in connection with the flowcharts of FIGS. 9 and 10, there are various ways to create a permanent magnet 112' having a shaped magnetic bias. In one embodiment, the desired magnetic field shape is created by printing a magnetic field to one or more regions of the permanent magnet 112' in such a way that the permanent magnet 112' has one or more regions that are selectively/controllably demagnetized in such a way that the structure has a desired predetermined shaped magnetic bias, which in one embodiment is a radially varying axisymmetric magnetic bias. Advantageously, in one embodiment, the permanent magnet 112' is fully magnetized to its retentivity point; that is, the magnet reaches its point of maximum retentivity on the BH curve (the hysteresis loop showing relationship between the induced magnetic flux density (B) and the magnetizing force (H)) prior to being demagnetized. In at least one embodiment, the permanent magnet 112', prior to being selectively/controllably demagnetized, is magnetized to some predetermined level of or point on its BH curve.

In addition, as one of skill in the art will appreciate, in one embodiment, it may be necessary to at least partially demagnetize (or further magnetize) a given ferrite resonator (or even a given hexaferrite resonator, as described further herein) to help to achieve a uniform magnetic field, especially if the ferrite or hexaferrite is not starting with a desired magnetization for a given application. It is possible, in at least one embodiment, to adapt the method of FIG. 9 to accomplish this degmagnetizing and/or magnetizing of the ferrite/hexaferrite.

As is understood in the art, magnetizing a magnetizable material is accomplished by exposing the magnetic material to a sufficiently intense magnetic field that is established in the same direction as the magnet's orientation. This creates a permanent magnet. However, when a part or all of a magnetized permanent magnet is exposed to a strong magnetic field that is established in opposition to the magnet's magnetization, the portions exposed to this opposite magnetic field become demagnetized, to reduce the effective field of the permanent magnet. By starting with a magnet that is substantially fully magnetized (having a magnetic flux, after magnetization, that is substantially at its retentivity point), and then using one or more of the methods described herein (e.g., in FIG. 9) for demagnetization of certain regions of the magnet, in a carefully controlled manner, it is possible to re-shape the magnetic field in the magnetized permanent magnet to any desired shape. This carefully selected and controlled precise demagnetization, to produce a permanent magnet with shaped magnetic bias, is possible because the degmagnetization methods described herein (using the magnetic printer, using a laser beam to apply heat) permit precision in targeting the areas for selective and/or controllable demagnetization.

For example, in one embodiment, a device such as the aforementioned magnetic printer (also referred to herein as a "magwriter" or the "CMR MagPrinter"—see below) is usable to print a desired magnetic field (whether for magnetizing or for demagnetizing) in a controlled and accurate manner. In one embodiment, this applied magnetic field has a varying opposite polarity to the magnetization in the area of the permanent magnet where the applied magnetic field is being directed, resulting in a selective demagnetization of the permanent magnet in those regions where the applied magnetic field is directed. In a further embodiment, a printer like the CMR MagPrinter also can be used to create a permanent magnet 112' having a shaped magnetic bias by not only applying an appropriate magnetic field, but also by actually first printing the magnet itself (certain types of MagPrinters available from CMR, as explained below) are able to actually print magnetic devices). This latter embodiment can be more time consuming to manufacture (because it must first be printed).

A magwriter (also referred to herein as magnetic printer) is a device that is capable of printing a magnetic field to a material, wherein, depending on the way the field is printed, the device can be magnetized or demagnetized. For example, at least one exemplary type of magnetic printer usable with at least some embodiments of the invention is the CMR MagPrinter device, available from Correlated Magnetics Research (CMR), LLC of Campbell Calif. and Huntsville Ala.

The CMR MagPrinter is part of a system that features a computer-controlled platform that moves a platform tray relative to a specialized printhead that produces a focused high intensity magnetizing field that creates a single, well-defined, resonant magnetic source element (maxel) at a prescribed location, where the CMR MagPrinter can print maxels on the surface of any permanent magnet material from rare-earth based materials to ceramics, and even flexible materials. That is, this type of magnetic printer is capable of printing a magnetic field to virtually any magnetic material.

The printing of the magnetic field (e.g., via the MagPrinter) also can be implemented in a way to add a magnetic field to a portion of a previously unmagnetized material, or material that has previously become demagnetized, or that is under-magnetized, etc., to increase the magnetization in portion of a piece of material, as well as to selectively and/or controllably demagnetize, partially or fully, a portion of a piece of material. Use of the MagPrinter thus has the ability to control and change the magnetization in a structure (even a structure already assembled into a higher level circuit) and, as further described herein, to create specific patterns of magnetization that can be used to alter operation of devices and circuits.

In one embodiment, the magnetic printer is able to print the magnetic field by using a very small magnetizer (e.g., a coil wound around a solenoid), and then positioning the magnetizer near a small region of the material to be magnetized (e.g., 20 mil diameter circle, but this is not limiting) and then running a high current through the coil. The small coil couples the high current to create a magnetic field focused into a very small region, controllable in the x, y, and z directions, and this magnetic field is sufficient to magnetize the material in the region (if the material itself is a magnetizable material). One of skill in the art will appreciate that, depending on the orientation of the magnetic field, existing areas of a given material can be magnetized or demagnetized, to varying magnetization levels. Thus, the material treated with the magnetic printer, in this manner, can have its magnetization "shaped" in any desired manner. In addition, the CMR MagPrinter is capable of printing a field to a magnet such that the magnet can have different magnetic strengths depending on the distance from the magnet.

The CMR MagPrinter is used, in one embodiment, for magnetic writing to predetermined areas of permanent magnet material (which areas or regions are, in one embodiment, relatively small as compared to the size of the permanent magnet), such as one or more regions on the permanent magnet 112'. This magnetic writing results in magnetizing or demagnetizing selected regions or portions of the permanent magnet material, either fully or partially and with selective polarity. As will be appreciated, this permanent magnet with a controllable, shaped applied DC magnetic bias field thus allows an added degree of freedom to the magnetic circuit design, e.g., for the assembly/circulator 300 or any other device. For example, in one embodiment, the designed field shape is used to counteract at least a portion of the demagnetizing field resulting from and/or inherent in the shape of the ferrite resonator 120 (e.g., resulting from a substantially thin ferrite disk), thus obtaining a substantially uniform internal magnetic bias within the device, leading to improved circulator bandwidth. FIGS. 9 and 10, described further herein, provide methods for writing the field to one or more regions of the magnetizable material of the permanent magnet 112. The methods of these Figures also describe ways to use direct write extrusion to directly create a permanent magnet that is capable, by itself, of providing a shaped magnetic bias, or which can be further used with the CMR MagPrinter or exposure to heat (as described further herein) to provide further shaping of the magnetic field in the permanent magnet.

As noted above, with certain versions of the CMR MagPrinter, it also is possible, in one embodiment, to use the CMR MagPrinter to first print the entire permanent magnet, where the permanent magnet can be fully magnetized, have a predetermined magnetization, and/or can have one or more magnetization levels, as printed, and then subsequently selectively and/or controllably demagnetize the printed permanent magnet with the CMR MagPrinter. However, this process may be slower than using an existing fully or partially magnetized magnet, and then selectively/controllably demagnetizing the permanent magnet in one or more regions on the permanent magnet.

The availability of a magnetic writer such as the CMR MagPrinter, which is capable of magnetizing 20 mil diameter circles to varying magnetization levels is used, in at least one embodiment, to help create this permanent magnet with shaped magnetic bias, as shown in FIGS. 4A-4H, having a controllable shaped applied DC magnetic bias. That is, the precision that is possible with the CMR MagPrinter helps to enable shaping of the magnetic field, and, thus, the magnetic bias. As noted above, the CMR MagPrinter is one known usable device for magnetizing predetermined regions to varying magnetization levels. In addition, at least one magnetic writing device usable with at least some embodiments of the invention is described in United States Patent Publication Number 2014/0299668, published on Oct. 9, 2014, which is hereby incorporated by reference. Additionally, magnetic devices incorporating principles and disclosures of other United States patent documents are usable with at least some embodiments of the invention, including but not limited to the disclosures described in U.S. Pat. No. 7,982,568 (issued Jul. 19, 2011); U.S. Pat. No. 8,179,219 (issued May 15, 2012); and U.S. Pat. No. 8,760,250 (issued Jun. 24, 2014); the contents of each of these patents is hereby incorporated by reference. It is anticipated that the methods, systems, and devices described herein will be implementable using virtually any device capable of precisely shaping the magnetic field in a permanent magnet.

The embodiments described herein provide for additional ways to shape the magnetic bias in a permanent magnet besides using a magnetic printer to print a magnetic field to the permanent magnet. For example, as will be discussed further herein, in one embodiment, the structures as described in FIGS. 4A-4H also can have its magnetic field shaped using controlled application of heat (e.g., via a laser), to produce a substantially identical demagnetizing result as was produced by using the CMR MagPrinter. In addition, in one embodiment, discussed further herein the permanent magnet structure of FIGS. 4A-4D can be produced using a direct write extrusion process, which process is detailed in FIG. 10, which process is capable of being used by itself and/or being combined with either or both of the methods that use the CMR MagPrinter and the controlled application of heat.

Referring again to FIGS. 4A-4D, the structure shown in FIGS. 4A-4D also can be adapted to be manufactured using other ferrite materials, such as hexaferrites (also referred to as hexagonal ferrites). Using a hexaferrite material in place of some or all of the components in the devices of FIGS. 4A-4D (as described further below in connection with FIGS. 4E-4H) allows the resulting devices to operate as self-biasing devices, which can eliminate the need for the bias magnet 112'-thus reducing bulk and weight. The hexaferrite material itself can have its magnetic bias shaped in the same manner and using the same methods described herein as for conventional permanent magnets.

Figure 4E:
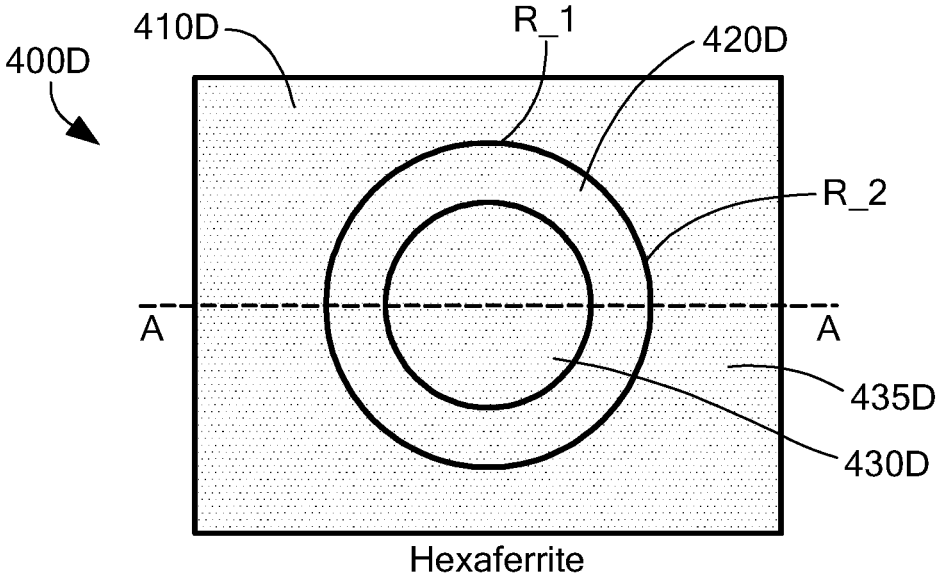
FIG. 4E is a top view of a of a first embodiment of a self-biased stripline circulator, which for illustrative purposes is shown as comprising a hexaferrite material, the self-biased circulator configured to have a shaped magnetic bias.
Figure 4F:
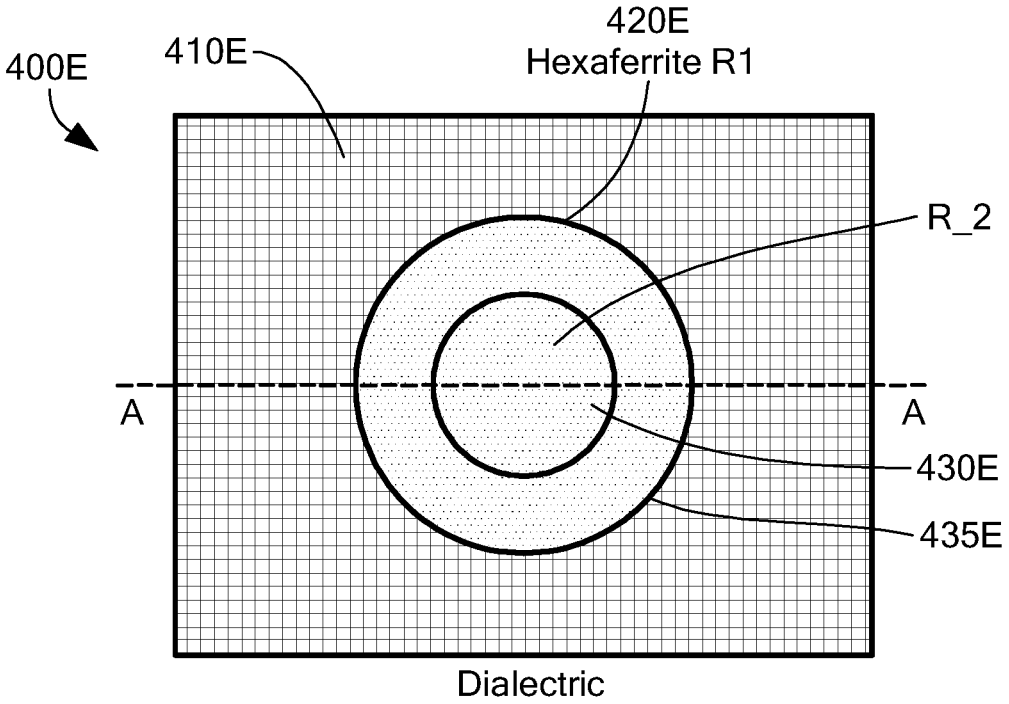
FIG. 4F is a top view of an embodiment of a self-biased stripline circulator, which for illustrative purposes is shown as comprising a hexaferrite-based substrate that includes hexaferrite material, the substrate configured to have a shaped magnetic bias.
Figure 4G:
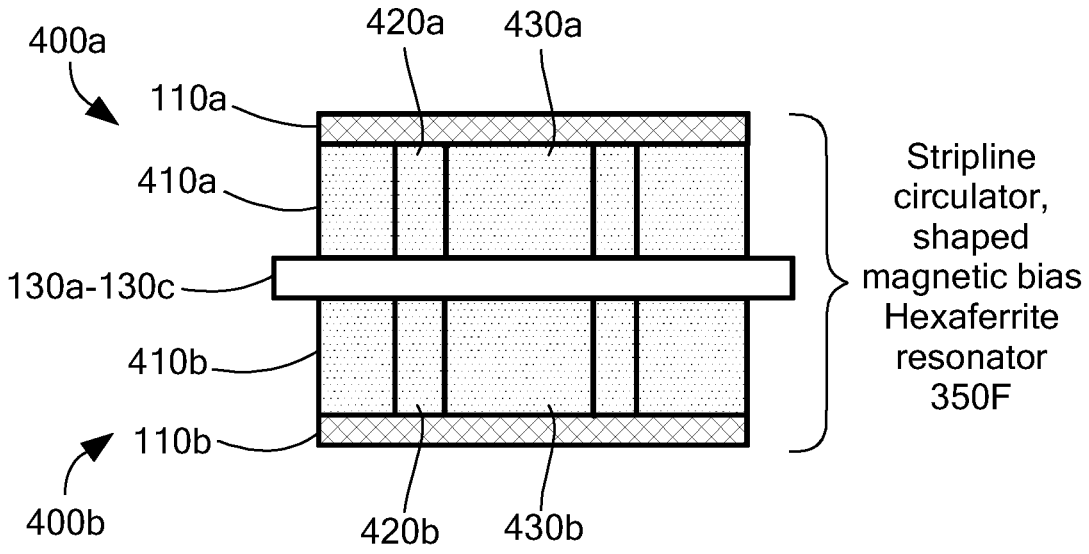
FIG. 4G is an illustrative cross-sectional view, taken along the A-A line, of the self-biased stripline circulator of FIG. 4E.

For example, FIG. 4E is a top view of a first embodiment of a self-biased stripline circulator 400E, which for illustrative purposes is shown as comprising hexaferrite material, the self-biased circulator 400E configured to have a shaped magnetic bias. As FIG. 4E illustrates, the entire circulator structure 400E is made from hexaferrite, where the first "ring" region R1 420A has a first magnetic bias and the second "ring" region R2 430A has a second magnetic bias, wherein the magnetic bias can be shaped in a manner similar to that described above for the permanent magnets 112*a*', 112*b*'. That is, the complete structure in FIG. 4E can be formed, in on embodiment, using a single piece of hexaferrite, with the magnetization appropriately shaped, and because it is using hexaferrite, it is possible to have a self-biased structure requiring no external magnets to provide biasing (e.g., as shown in FIG. 4G, which is an illustrative cross-sectional view 350F, of the self-biased stripline circulator 400E of FIG. 4E, taken along the A-A line of FIG. 4E. The cross sectional view 350F shows first and second hexaferrite structures 400E, 400E, operably coupled to the conductors 130*a*-130*c* and to respective ground planes 110*a*, 110*b*. As this view shows, no permanent magnets are required.

Referring again to FIG. 4F, the entire circulator structure 400E, in one embodiment, (except for the conductors 130*a*-130*c*) is made from a hexaferrite material, with Region 1 420A being magnetized (e.g., via the same methods usable for FIG. 4A) to have lower magnetization, and Region-2 430A being magnetized to a higher magnetization. FIG. 4F is a top view of an embodiment of a self-biased microstrip circulator 400E, which for illustrative purposes is shown as comprising a hexaferrite-based resonator structure 435E that includes first and second regions 420E, 430E, of hexaferrite material that together are configured to have a shaped magnetic bias. In FIG. 4F, the structure 400E is made using a region 410B of dielectric and a resonator disk 435B made of hexaferrite material. In either structure, in an optional embodiment, once the bias field is shaped (e.g., using the methods discussed above in connection with FIG. 4A), the resulting structure is able to operate as a self-biased circulator device 400E and thus, as will be understood, may not requires the use of a bias magnet 112. Accordingly, a magnetizable material can be fabricated using hexaferrite material (e.g., as shown in FIG. 4E or 4F, described further herein), have its bias shaped (e.g., with a radially varying axisymmetric magnetic bias, using any method described herein), and then be fabricated into a circulator (e.g., as shown in FIG. 4G or 4H).

Figure 4H:
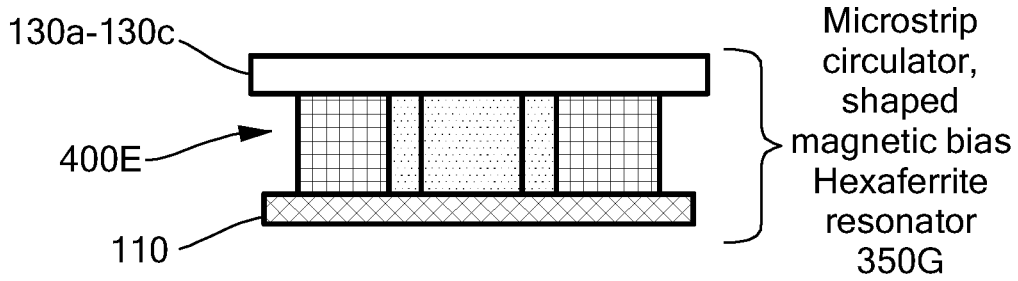
FIG. 4H is an illustrative cross-sectional view, taken along the A-A line, of the self-biased microstrip circulator of FIG. 4F.

FIG. 4H is an illustrative cross-sectional view 350G, taken along the A-A line of FIG. 4F, of the self-biased three port microstrip circulator of FIG. 4F. As FIG. 4H illustrates, no permanent magnet 112 is needed for biasing. Use of hexaferrite in the structures of FIGS. 4E-4H provides significant size and weight advantages over heavier and bulker structures made using different types of materials and requiring permanent magnets, as will be appreciated, because the hexaferrite material does not require an external permanent magnet to help maintain its magnetic bias. Those of skill in the art also will appreciate that use of a single piece of hexaferrite material, without need for external magnets or an assembly of different materials (possibly having different coefficients of thermal expansion) can present advantages during operation, especially over temperature extremes.

As noted previously, in at least one embodiment (see block 1325 of FIG. 9, described further herein), a magnetic printer also is used to print the magnetic structure itself, before magnetizing, because at least some types of magnetic printers, including the CMR MagPrinter, are able to print individual magnetic elements, each magnetic element having an individually controllable magnetization, and these elements can be printed on top of many different types of materials or substrates. In accordance with at least one embodiment described herein, a magnetic structure, e.g., a permanent magnet, created using the plurality of individual magnetic elements can, if necessary (e.g., if not printed with a shaped magnetic bias) later be selectively and/or controllably demagnetized to create a shaped magnetic bias in the structure.

It will be appreciated that any device capable of selectively and/or controllably magnetizing permanent magnetic material, or that is capable of producing a correlated or programmable magnet, is usable, in accordance with the embodiments described herein, help custom magnetize the shape of the magnetic field in the bias magnet. In addition, as will be appreciated, devices such as computer systems and/or controllers are usable, in at least some embodiments, to control the device (e.g., CRM MagPrinter or laser) that is performing the controllable selective demagnetization. The engineered and controlled shaping of the applied magnetics bias from the permanent bias magnet 112, via controlled/selective demagnetizing, thus helps to overcome at least some of the shape demagnetizing effects of the ferrite resonator 120. In addition, it has been found that a uniform internal field that 'just" saturates the ferrite results in the greatest bandwidth.

In another embodiment, the permanent magnet structure 112*a*', 112*b*' of FIGS. 4A-4E is formed to have a shaped magnetic bias by physically fusing/joining together one or more substantially concentric and coplanar rings of magnetizable material, each with a differing magnetization, to form a composite permanent magnet structure having a shaped magnetic bias. This is done, in one embodiment described further herein (see the method of FIG. 10) via direct write extrusion, but it will be appreciated that other known methods of physically coupling together materials of differing magnetization, in an integral or monolithic manner, to achieve the permanent magnet structures 112*a*', 112*b*', of FIGS. 4A-4H, is usable in accordance with the disclosed embodiments.

Figure 5A:
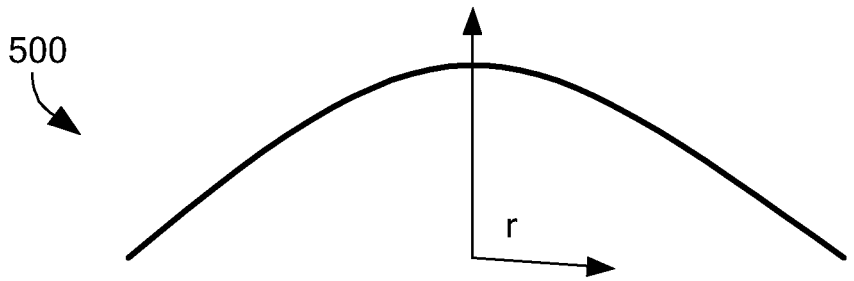
FIGS. 5A-5C are additional illustrations showing the direct current (DC) magnet's field shaped with magnetic material composition, in accordance with one embodiment.
Figure 5B:
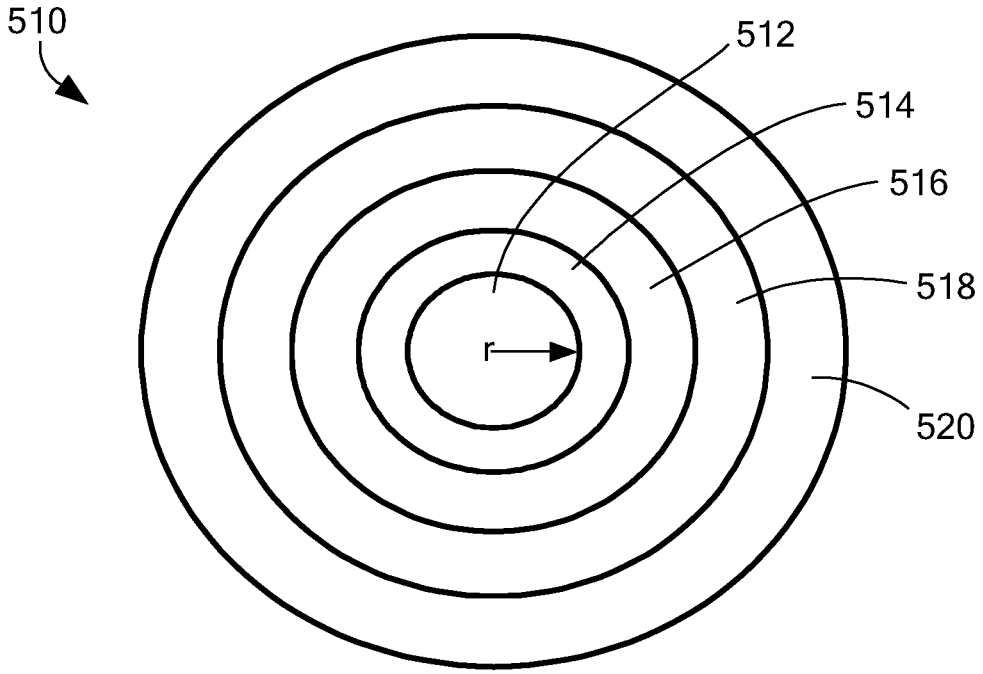
Figure 5C:
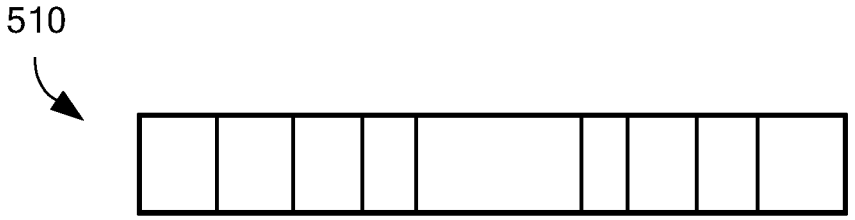

FIGS. 5A-5C are additional illustrations showing the direct current (DC) bias magnet's field shaped with magnetic material composition, in accordance with a third disclosed embodiment. The illustrations of FIGS. 5A-5C are applicable, in at least one embodiment, to any of the structures shown in FIGS. 4A-4H. In particular, FIG. 5A shows the direct current (DC) magnet 112 field shaped with magnetic material composition, in accordance with a third disclosed embodiment and includes a graph 500 of net magnetic field strength as a function of radiation position. As FIG. 5A illustrates, the net magnetic field decreases as the radiation position increases. FIGS. 5B and 5C are top and cross-sectional views, illustrating (via changes in shading) one embodiment of a shaped dc magnetic bias built into a magnet 510 (which can correspond to any of the permanent magnets 112 in the structures of FIGS. 4A-4D or the hexaferrite structures of FIGS. 4E-4H) having a shaped magnetic bias that has been shaped using any of the methods described herein, including but not limited to direct writing of the magnetic field (e.g., with a device such as the CMR MagPrinter), direct write extrusion of materials having varying magnetic field strength (described further herein), and exposure to varying thermal field in the radial direction (also described further herein).

Referring to FIGS. 5B and 5C, the magnetic device 510 (e.g., permanent magnet) is, in one embodiment, a substantial disk shape includes four substantially concentric and coplanar rings of magnetic material 514, 516, 518, 520, each ring having a different remanent magnetization (represented by the variations in shading), about a central ring 512 (to which the rings are all substantially coplanar and concentric), where the central ring region 512 is configured to have the highest remanent magnetization (magnetic field strength under a magnetic saturation), with remanent magnetization gradually decreasing as distance from the center is increased, as shown in FIG. 5A. Advantageously, in one embodiment, the structure 510 is manufactured so that the remanent magnetization level in each concentric ring provides predetermined different field strength when magnetized, and, in combination with the other rings, forms a desired shaped magnetic bias pattern across this structure 510. Advantageously, in at least one embodiment, the shaped external magnetic bias field resulting from this arrangement is selected so that, when it is used to bias a ferrite resonator disk 120, the shaped external magnetic bias field helps to counteract at least a portion of the demagnetizing effects of an overall shape of the permanent magnet 510 itself, so as to achieve a substantially uniform internal magnetic bias within the circulator or other magnetic bias device 500. In one embodiment, the magnetic material composition of each respective ring 512-520 is selected so that the magnetic field strength varies radially from the center of the permanent magnet structure 510 towards the periphery of the structure. For example, in one embodiment, the magnetic material composition in the ring 512 is selected such that it has high magnetic field strength under magnetization and the magnetic material composition in the ring 510 is selected to have low magnetic field strength under magnetized condition.

In the embodiment of FIGS. 5A-5D, therefore, the shaped DC magnetic bias is built into the magnetic device assembly 510 (e.g., the permanent magnet 510). It will be understood that the number of layers or rings 512-520 shown in FIGS. 5B and 5C (the rings representing differing areas of magnetic field strength), along with the respective sizes, thicknesses, and shapes of the respective layers/rings, is illustrative and not limiting. There can be more or fewer rings, the thickness can vary, etc., as will be appreciated, depending on the desired shaped magnetic bias to be implemented in the permanent magnet 510. The arrangement of five substantially concentric and substantially coplanar rings of material results, in one embodiment, in a shaped D.C. magnetic radially varying axisymmetric bias being built into the permanent magnet 510, where the bias varies continuously from being at its highest magnetization (highest magnetic field strength) in the center all the way to lowest magnetization (lowest magnetic field strength) at or near the outermost edges of the outer ring 520. Advantageously, in one embodiment the rings 512-520 have a magnetic field strength are configured such that, if the magnetic bias device is used in a component such as a circulator, during operation of the circulator, the ferrite has a substantially uniform bias field at just below saturation in a direction that is transverse to that of a signal propagation through the circulator. This helps to improve circulator bandwidth and reduce insertion loss. For example, in one embodiment, the rings 512-520 provide a magnetic field strength that is used to bias a ferrite resonator 120 such that, during operation of the circulator, the circulator has a bandwidth that is greater than that of a circulator that uses a fully magnetized magnet without a shaped magnetic bias.

In one embodiment, any one or more of the rings 512-520 are produced by printing out an array of magnetic material using the aforementioned CMR MagPrinter, as described above. In one embodiment, the disk 512 and ring 514-520 are formed from a single piece of material (e.g., ferrite or hexaferrite) and the magnetic field is printed directly to the structure, as described above.

Advantageously, in one embodiment, the composite magnetic material is fired, polished and finished to the requirements of the application. Magnetizing the composite magnet 510 first saturates all the regions (e.g., all the layers 512 through 520) to different magnetic field values depending on the material used, and these magnetic field values then drop to a plurality of respective the retentivity points when the magnetizing force is removed. This results in shaped magnetic bias.

As is known from the aforementioned '264 patent, to increase bandwidth of a device such as an edge mode circulator, phase coherency needs to be maintained over one half the wavelength distance, which is denoted as $\lambda/2$. High frequency signals thus couple most strongly near the center of the circuit, and low frequency signals couple most strongly near the edge of the circuit. Since the operation of a ferrite device requires the magnetization to scale with frequency (known in art as the gyromagnetic ratio), an increased bandwidth can be expected if a circulator is made using a magnet/ferrite combination having different magnetizations to be scaled with the propagation wavelengths, to be larger (i.e., higher magnetic saturations) at the center of a ferrite disk, but smaller magnetic saturations at the edge of the ferrite disk. Thus, in at least some embodiments, for optimum bandwidth, in addition to the use of the permanent magnet with shaped magnetic bias, it is advantageous to further use the composite ferrite resonator, configured as discussed herein.

In addition, as will be understood by those of skill in the art, the shape of the magnetic field can be selected to compensate for degmagnetization effects caused by certain ferrite shape factors (such as factors associated with a thin ferrite disk) or for at least a portion of at least some of the demagnetizing effects that may occur in virtually any type of device.

In devices that use a magnetic bias device having a shaped magnetic field, it will be appreciated that the following equation applies:

$$\text{Internal Field} = \text{Applied Field} - (\text{Magnetization} \times \text{Shape Factor}) \quad [1]$$

It can be seen that, using equation [1], for a known shape factor, a magnetization exists that can help to reduce its effects on the Applied Field and/or to ensure that the internal field is substantially uniform.

Figure 6:
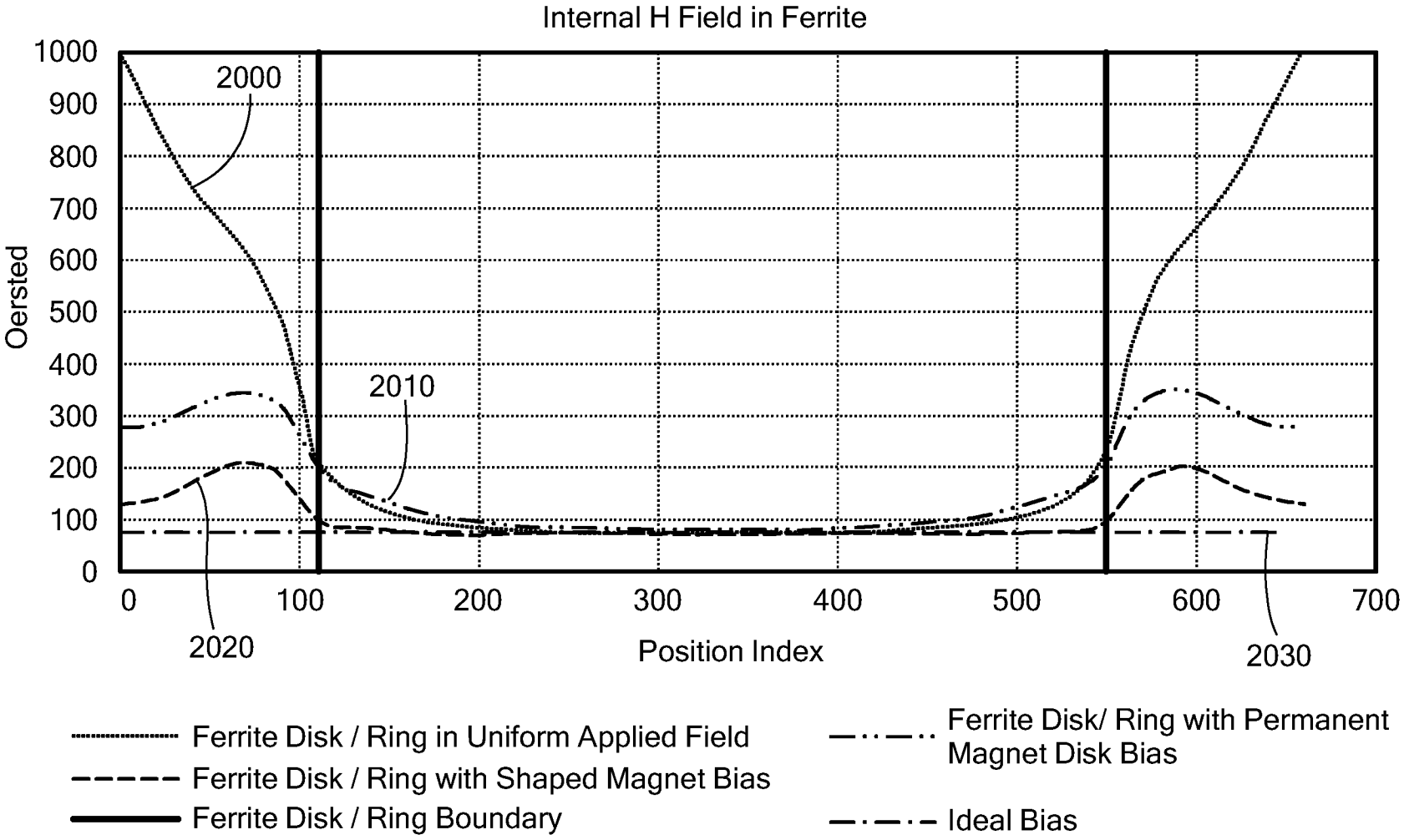
FIG. 6 is an exemplary graph showing simulations of variations in the internal field of various configurations of rink/disk ferrites in various applied fields, in comparison with an ideal bias, in accordance with one embodiment.

FIG. 6 is an exemplary graph showing simulations of variations in the internal field of various configurations of ring/disk ferrites and applied field, types of ferrite disks in various applied fields, in accordance with one embodiment. In particular, FIG. 6 shows the internal H (magnetic) field in a ferrite resonator, in Oersteds (Oe) as a function of a position on the ferrite (e.g., using a position index, corresponding to a position, from 0 to 700, along a ferrite disk, where the middle position approximately corresponds to the center of the ferrite, and where the solid vertical lines show the disk/ring boundaries). As FIG. 6 illustrates, a ferrite having a ring and disk configuration, in a uniform applied field (no shaped magnetic field from the permanent magnet), shown as line 2000, has the largest variation in internal magnetic field as position across the ferrite changes, with particularly large variations in the outer ring regions of the ferrite. The next biggest variation in internal magnetic field, as a function of position, is for a ferrite disk/ring with permanent magnet bias, shown as line 2010. The least amount of variation (that is, the most substantially uniform internal field) results from the ferrite disk/ring with a shaped magnetic bias, shown as line 2010. In particular, note that the ferrite disk/ring with shaped magnetic bias, line 2020, is nearly or substantially flat in the disk region (area between the two vertical lines), with a very little variation in the disk region as compared to the other illustrated embodiments. For the purposes of this application, fairly uniform and substantially uniform, in terms of magnetic bias, refer, in one embodiment, to a variation of about 25-40% in internal magnetic field. For example, in one embodiment, a substantially uniform magnetic bias means that the magnetic bias varies by not more than 25-40% (or even less) over the inner ferrite disk and/or over the outer one half to two thirds of the disk and ring (i.e., not counting a small area around the center of the disk. In comparison, conventional non-uniform magnetic bias variation can vary by 300-350% over the same areas.

Figure 8:
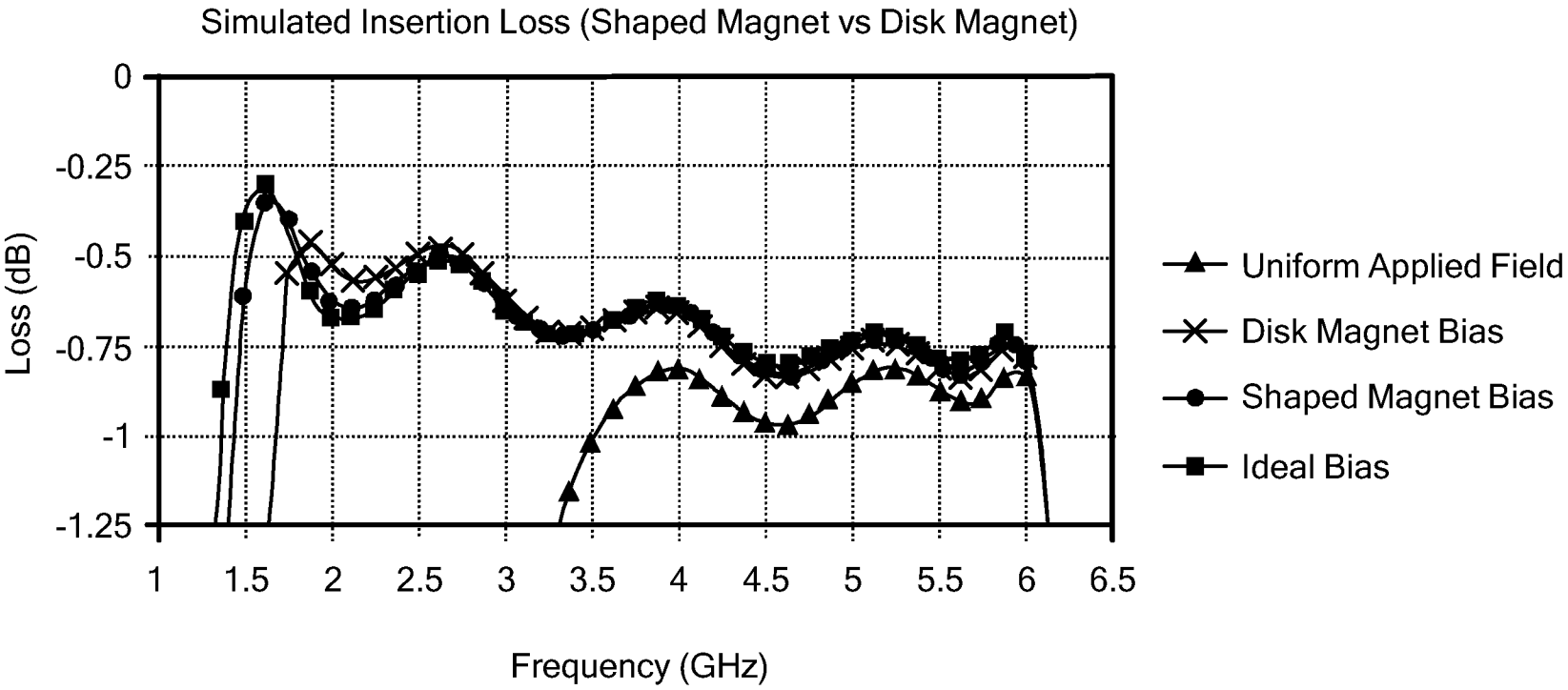
FIG. 8 is an exemplary graph of the data of FIGS. 7A and 7B, in accordance with one embodiment.

FIGS. 7A and 7B are top and bottom halves, respectively of an exemplary table showing, at various frequencies, a simulated insertion loss for four different types of internal magnetic bias fields in a circulator: uniform applied field, a bias field from a disk magnet (with no shaped magnetic bias), a bias field from a shaped magnet (having shaped magnetic bias), and an "ideal" magnetic bias field (i.e., one that substantially compensates for disk shape issues of the ferrite disk). FIG. 8 is an exemplary graph of the data of FIGS. 7A and 7B. As FIG. 8 shows, the shaped magnet bias graph shows that the insertion loss at, for example, 1.5 GHz, is about −0.6 dB with a shaped magnet bias configuration, enabling signal transmission even at that frequency, but is quite large with the disk magnet bias configuration (e.g., enough to prevent signal transmission and reduce bandwidth by nearly 0.5 GHz. FIG. 8 also shows that the insertion loss associated with the shaped magnetic bias is very close to the "ideal" magnetic bias field. FIG. 8 also illustrates the significant increase in bandwidth (approximately 1.9 GHz increase) for a shaped magnetic bias applied field as compared to a uniform applied field.

Referring again to FIGS. 4A-4H and 5A-5C, these structures also can be created, in one embodiment, by exposing the magnetizable material to varying thermal field (e.g., heat) in the radial direction, in accordance with one disclosed embodiment. For example, in one embodiment, the magnetic field of the permanent magnet 112*a*', 112*b*' is shaped by laser thermal treatment of a piece of magnetizable material. For example, in one embodiment, a magnetic structure, such as permanent magnet 112, has substantially coplanar and concentric inner ring 330A and outer ring region 320A, as shown in FIG. 4A, where the inner and outer regions each comprise a magnetizable material (advantageously, the same material), wherein the inner and outer region 330A, 320A, respectively, each have at least one respective first and second region that has been exposed to a varying temperature field, the varying temperature field being sufficient to demagnetize at least one of the first and second regions 330A, 320A sufficiently to create a shaped magnetic field in the magnetic bias device.

The varying field can include application of heat (e.g., in the form of energy from a laser beam) from a heat source (e.g., a laser beam formation device) capable of providing heat to a predetermined region, at a predetermined temperature, to produce a magnetic bias in a permanent magnet having an area of highest magnetic field strength towards the center and lowest magnetic field strength toward the outer edges. In one embodiment, the variation in bias is substantially continuous from the center to the edge.

As is known in the art, the Curie temperature ($T_c$), or Curie point, is the temperature where a material's permanent magnetism changes to induced magnetism (i.e., the point when a magnet becomes demagnetized due to temperature). The $T_c$ varies by material: the $T_c$ of ferrite, for example, is 460° C. After heating a given region of the magnet 2010 to its Curie temperatures and then cooling the magnet 1210, the region that was heated will have a different (e.g., lower) magnetic field strength than regions of the magnet not exposed to the heat.

It is known that devices such as lasers can provide a focused beam of energy capable of heating whatever it strikes to a very high temperature, including, for some materials, the Curie temperature. This feature is usable to help create in the material (by heating the material at or near its Curie temperature) a change in the magnetization of the material, for example demagnetization. Depending on how this is done, a structure having a radially varying axisymmetric magnetic bias can be formed via this selective and controllable thermal exposure, by selectively magnetizing and/or degmagnetizing the material to create a shaped magnetic bias. The structure to which the laser energy (or other thermal energy) is applied can be formed in any of the ways described herein, or in other ways known in the art. One or more portions of the structure 300 are selectively and controllably exposed to temperatures sufficient to change their magnetic field strength and thus create a shaped magnetic bias. Further, those of skill in the art will appreciate that a single magnet structure can be made using a combination of one or more of any of the methods described herein. FIG. 9 further describes one method for doing this, in accordance with one embodiment.

For example, referring briefly to FIGS. 5A-5C, the same illustration of magnetic field and varying magnetic bias, as shown by the varying shading of the rings 512-520, is equally applicable for embodiments where the bias is shaped via thermal exposure. In one embodiment, each ring 512-520 comprises the same material, but has a different respective magnetic field strength that is formed via thermal exposure. In one embodiment, at least some of the rings 512 through 520, in addition to having a different respective magnetic field strength, also are formed using a different material, such that the structure 1210 comprises at least two different magnetic materials. (This is accomplished, in one embodiment, via direct write extrusion, as described further herein). The structure 510, in one embodiment, has one or more regions on it (which regions, in some embodiments, correspond to the disk/rings 512-520, which are demagnetized (wholly or partially) by exposing the respective region(s) to a temperature that is at a high temperature but, in at least one embodiment, is below the material's Curie temperature. As will be appreciated, the closer the high temperature is to the Curie temperature, the greater the demagnetization in the region (e.g., the local reduction in net magnetic field in the region that was exposed to the temperature).

In one embodiment, the structure 510 comprises a first portion of rings 512 through 520 made from a first material, and a second portion of rings 512 through 520 made from a second material, and a respective region in each for the first and second materials is exposed to a respective, appropriate temperature that is at or below the Curie temperature for that material, depending on the degree of demagnetization desired, as will be appreciated. The first and second materials, in one embodiment, are two different magnetic materials. For example, in one embodiment, the structure 510 is or was made using the direct write extrusion method of FIG. 10.

In one embodiment, the innermost region 512 of the magnetic structure 510 (e.g., permanent magnet) has a minimum local thermal exposure following magnetization, and the outermost region 520 has maximum local thermal exposure following magnetization. In one embodiment, a laser beam performs the thermal treatment of the magnetic structure 510 by increasing the temperature of a predetermined one or more regions of the magnetic structure 510. Those of skill in the art will appreciate that the frequency of the laser beam can be selected to be appropriate based on the material of the magnet. For example, in one embodiment, using tripled YAG frequencies (or other appropriate frequencies) and heating the outer edge of the device 510 to its highest appropriate temperature (but below the Curie temperature) reduces the net magnetic field locally by the maximum amount. In one embodiment, the laser thermal treatment includes one or more of manipulating the laser frequency, power level, pulse width, and/or other parameters, across a radial direction in the device 510, which helps to shape the resulting magnetic field, resulting in a shaped magnetic bias in the magnet. FIG. 9, described further herein, is a first flow chart showing several methods for creating a magnet structure (e.g., permanent magnet) having a shaped magnetic bias, where the magnetic bias is shaped via selective, controllable demagnetization (e.g., via application of thermal energy or using the magnetic printer, as described above).

Referring briefly to FIG. 9, at the start (block 1310), a structure is provided or created from a portion of a magnetic ceramic material (a magnetized structure) (block 1320). That is, the structure is formed from a material that is magnetizable and is provided for further application of a shaped magnetic bias. For example, in one embodiment, the structure could have been formed from any other process and can later be combined with the method of FIG. 9 to provide selective and/or controllable demagnetization and thus further shaping. Advantageously, however, the direct write extrusion method of FIG. 10 is sufficient by itself to create a permanent magnet having a shaped magnetic bias, as discussed further below. In one embodiment, a magnetic printer (e.g., the CMR MagPrinter as described previously) can print or create a discrete magnetic structure (block 1325) having a built-in shaped magnetic bias. In one embodiment, the structure in block 1320 can be a pre-existing structure made from magnetizable material, including (as noted previously) hexaferrite. In a still further embodiment, the structure of 1320 is part of an already fielded device (e.g., a circulator already installed in a next higher assembly), where the process of FIG. 9 is used to change the magnetization of one or more components (including but not limited to bias permanent magnets) in the existing device (e.g., to re-magnetize a component, to shape magnetic bias in an existing component, to selectively and/or controllably demagnetize a component, etc.). Optionally, in one embodiment, the structure is magnetized to its saturation value, before the magnetizing force is removed and the structure reaches maximum retentivity point (block 1335), before selective and/or controllable demagnetization begins in block 1340.

From block 1340, the process for shaping the magnetic field is selected, and can proceed in one of two different ways, depending on how the magnetic shaping is being done. Advantageously, this process can begin with a magnet structure (e.g., a permanent magnet) that is magnetized to its retentivity point, such that one or more regions can be selectively and/or controllably demagnetized, via the processes described herein, to shape the magnetic strength and, thus, effectively, the magnetic bias in the structure. For example, in one embodiment, the magnetic field is shaped via a magnetic printer, as described herein (block 1345), by printing a magnetic field to the magnetic ceramic material (block 1350), where the magnetic field can act to selectively and/or controllably degmagnetize (as described previously) or even to re-magnetize, if applicable and appropriate.

In one embodiment, the magnetic field is shaped by application of heat, such as via a laser, as described herein (block 1360), in a desired manner, to create a shaped magnetic bias (blocks 1370-1380) by selective and/or controllable demagnetization of at least a portion of the structure. In either of the two processes, the result, in one embodiment is structure in which one or more portion(s) of the structure is/are selectively and/or controllably magnetized and/or demagnetized, in a desired pattern (e.g., in one embodiment, in a radially varying pattern, as described herein) (blocks 1370 and 1380).

In block 1320 of FIG. 9, optionally, the structure having its magnetic bias shaped also can result from other processes, such as the direct write extrusion process of FIG. 10 (note that the direct write extrusion process can, by itself, produce a structure having a built-in shaped magnetic bias following magnetization). The magnet structure, in at least one embodiment, thus can be a composite magnet structure formed by rings of different material that are monolithically joined together and appropriately magnetized.

FIG. 10 is a second flow chart showing a method of creating a device having a shaped magnetic bias. Direct write extrusion, in accordance with one embodiment involves a constant extrusion of material. For example, direct write devices are known in the art which are capable of directly writing material, e.g., 2 different materials, in an extruded manner, where the direct write machine extrudes material, writing the material and consistently changing the mixture between the two materials. The result is a material having a gradient distribution of magnetizable material disposed in it. The structure created in this manner is then provided to a device or machine capable of shaping the magnetic bias on the structure via selective and/or controllable demagnetization, such as the shaping processes of FIG. 9 or via a magnetizer.

Referring to FIG. 10, at the start (block 1410), the direct write extrusion process starts with a first ceramic powder with a high magnetic strength (e.g., a higher concentration of magnetic material) (block 1420) and a second ceramic powder with low to no magnetic strength (block 1430). The first and second powders are mixed and extruded into a structure via a direct write process, to form a magnetic ceramic structure (block 1440) (e.g., a structure such as the magnetic disk of FIGS. 4A-4D). The magnetic ceramic structure thus has, built into it, a varying magnetic material composition, which inherently will magnetize to varying magnetic strengths in the structure, given identical applied magnetizing force. In one embodiment, the first and second materials are selected, mixed, and extruded such that the highest magnetic field strength is at the center of the magnetic ceramic structure (e.g., as in 512 of FIG. 5B), and such that the lowest magnetic field strength is at the periphery of the structure (e.g., as in 520 of FIG. 5B). In one embodiment, there is a radially varying gradient of varying magnetic field strength in the structure. In one embodiment, the structure of block 1440 has substantially concentric and coplanar rings of magnetic material, as in FIG. 5B. The composite magnetic structure is fired, polished and finished to the requirements of the application (block 1445).

The structure is provided to a magnetizer to magnetize the structure (block 1450), and magnetization can be done in several different ways. For example, inn one embodiment, the structure could be to the process of FIG. 9 (e.g., for magnetization to maximum magnetic field strength, then removing the magnetizing force to reach the retentivity point, then shaping the magnetic bias via either the magnetic printer of via the thermal/laser method). In one embodiment, the structure of block 1450, instead of magnetized to maximum magnetic field strength, via the method of FIG. 9, is instead provided to a magnetizer (block 1450) to magnetize the composite material in the structure so as to reach maximum magnetic field strength, at different magnetic field values, depending on the material used and the corresponding magnetic material composition.

For example in one embodiment, the structure is first saturated by applying a magnetic field to it, the magnetic field being sufficient to saturate the structure, e.g., to fully saturate the structure. The magnetic structure can, for example, be passed through a solenoid through which high current is passed, such that the high current induces a magnetic field in the center of the solenoid, where the structure is located. However, because the structure was fabricated with varying magnetization levels, different locations on the structure are magnetized to different magnetic field strength values (block 1450). When the magnetizer is removed (magnetizing force is removed), each respective location on the structure is that was magnetized to saturation while in the magnetizer, is then effectively magnetized to its respective retentivity point when the magnetizer is removed. The result is a structure with a radially varying magnetic field and a shaped magnetic bias (block 1460), which structure can be used as a bias permanent magnet in the circulator of FIGS. 4A-4D.

In at least some embodiments, the structure of any of FIGS. 4A-4H can be configured to be part of a device such as a circulator wherein, the shaped magnetic bias of the structure is configured such that, during operation of the circulator, the circulator has a substantially uniform bias field at just below saturation of the ferrite, in a direction that is transverse to that of signal propagation through the circulator. Advantageously, a circulator created using this method has a bandwidth that is greater than that of a circulator that uses a magnet without a shaped magnetic bias. Furthermore, in at least some embodiments, the circulator is configured to have a bias permanent magnet with a shaped magnetic bias that substantially counteracts any demagnetizing effects of an overall shape of the ferrite resonator disk 120, so as to achieve a substantially uniform internal magnetic bias within the circulator. In addition, it will be appreciated that at least one of the embodiments described herein is usable for and/or can be adapted to compensate for at least some of the demagnetizing effects in any device.

In describing and illustrating the embodiments herein, in the text and in the figures, specific terminology (e.g., language, phrases, product brands names, etc.) may be used for the sake of clarity. These names are provided by way of example only and are not limiting. The embodiments described herein are not limited to the specific terminology so selected, and each specific term at least includes all grammatical, literal, scientific, technical, and functional equivalents, as well as anything else that operates in a similar manner to accomplish a similar purpose. Furthermore, in the illustrations, Figures, and text, specific names may be given to specific features, elements, circuits, modules, tables, software modules, systems, etc. Such terminology used herein, however, is for the purpose of description and not limitation.

Although the embodiments included herein have been described and pictured in an advantageous form with a certain degree of particularity, it is understood that the present disclosure has been made only by way of example, and that numerous changes in the details of construction and combination and arrangement of parts may be made without departing from the spirit and scope of the described embodiments.

Having described and illustrated at least some the principles of the technology with reference to specific implementations, it will be recognized that the technology and embodiments described herein can be implemented in many other, different, forms, and in many different environments. The technology and embodiments disclosed herein can be used in combination with other technologies. In addition, all publications and references cited herein are expressly incorporated herein by reference in their entirety.

What is claimed is:

1. A method of making a magnetic structure having a shaped external magnetic bias field, the method comprising:

providing a first material comprising a first concentration of magnetic material;

providing a second material comprising a second concentration of magnetic material, the second concentration being lower than the first concentration; and extruding a varying mix of the first and second materials using a direct write extrusion process to create a substantially planar structure having a central axis and substantially concentric and coplanar regions with a gradient of concentration of magnetic material, the gradient oriented in a radial direction from the central axis radially towards an outside edge of the substantially planar structure;

magnetizing the substantially planar structure into a magnetic structure such that, when magnetized, the substantially planar structure becomes a magnetic structure that is configured to provide a shaped external bias magnetic field, the shaped external magnetic field configured to counteract at least a portion of a demagnetizing effect resulting at least in part from a shape of at least one of the magnetic structure and an external structure biased by the magnetic structure.

2. The method of claim 1, further comprising:

providing first, second and third conductors forming three equally spaced junctions;

operably coupling a ferrite resonator to the first, second and third conductors; and configuring the magnetic structure to apply the shaped magnetic bias field to bias the ferrite resonator, wherein the shaped magnetic bias field helps to counteract at least a portion of a demagnetizing effect arising from a shape of the ferrite resonator, and to achieve a substantially uniform internal magnetic bias within at least a portion of the ferrite resonator; and configuring the first, second, and third conductors, the ferrite resonator, and the magnetic structure to operate as a circulator.

3. The method of claim 1, further comprising configuring at least one of a magnetic saturation of the ferrite resonator and the magnetic bias of the magnetic structure to maximize circulator bandwidth.

4. The method of claim 1, further comprising configuring at least one of a magnetic saturation of the ferrite resonator and the magnetic bias of the magnetic structure to minimize circulator insertion loss.

5. The method of claim 1, further comprising configuring a magnetic printing process for implementing the magnetizing of the substantially planar structure into the magnetic structure.

6. The method of claim 1 further applying a controllable magnetic field to a first portion of the substantially planar structure, the controllable magnetic field having a size and polarity configured to selectively reduce a local magnetic field strength of the first portion such that the first portion comprises a demagnetized portion, where a first magnetic field strength in the demagnetized portion of the substantially planar structure and a second magnetic field strength in a second portion of the substantially planar structure, cooperate to shape the external magnetic bias field in the substantially planar structure.

7. The method of claim 6, further comprising configuring a magnetic printing process for implementing the selective reduction of local magnetic field strength.

8. The method of claim 1, further comprising configuring the gradient to be higher at the central axis than at the outside edge.

9. The method of claim 1, wherein providing the magnetic structure further comprises magnetizing at least a first substantially concentric and coplanar region to a respective retentivity point.

10. The method of claim 1, further comprising magnetizing at least a first substantially concentric and coplanar region to a respective predetermined retentivity point, prior to controllably reducing a local magnetic field strength in the first substantially concentric and coplanar region.

11. The method of claim 1, wherein the gradient of concentration of the substantially planar structure is configured to have a varying magnetic material composition in least first and second concentric and coplanar regions so that, when an identical magnetizing force is applied to the first and second concentric and coplanar regions, the first and second concentric and coplanar regions will have varying magnetic strengths.

12. The method of claim 1, further comprising configuring a distance between the magnetic structure and the external structure biased by the magnetic structure to shape the external bias magnetic field.

13. The method of claim 12, wherein the magnetic structure further comprises at least one of a spacer and a pole piece, and further comprising configuring a size of the at least one of a spacer and the pole piece to shape the external bias magnetic field.

14. The method of claim 1, further comprising applying a varying thermal field in a radial direction to at least a portion of the substantially concentric and coplanar regions of the magnetic structure to achieve at least partial demagnetization where the varying thermal field is applied, wherein the varying thermal field has a temperature that sufficient to alter the magnetization in a respective region where it is applied.

15. The method of claim 14, wherein the temperature of the varying thermal field is below a Curie temperature of the varying mix of the first and second materials that are in the portion where the varying thermal field is applied.

16. The method of claim 14, wherein the method further comprises heating the outer edge to a temperature that is a below a Curie temperature of the of the varying mix of the first and second materials that are at the outer edge where the varying thermal field is applied, wherein the heating of the outer edge is configured to reduce a local net magnetic field.

17. The method of claim 16, further comprising using at least one of a heat source and a laser source to apply at least a portion of the varying thermal field.

18. A method of making a magnetic structure, the method comprising:

providing a first material comprising a first concentration of magnetic material;

providing a second material comprising a second concentration of magnetic material, the second concentration being lower than the first concentration; and extruding a varying mix of the first and second materials using a direct write extrusion process to create a substantially planar structure having a central axis and having a gradient of concentration of magnetic material, the gradient oriented in a radial direction from the central axis radially towards an outside edge of the substantially planar structure, wherein the gradient of concentration is configured to provide a shaped external bias magnetic field.

19. The method of claim 18, wherein the gradient of concentration of the substantially planar structure is configured to have a varying magnetic material composition in least first and second concentric and coplanar regions so that, when an identical magnetizing force is applied to the first and second concentric and coplanar regions, the first and second concentric and coplanar regions will have varying magnetic strengths.

20. The method of claim 18, further comprising applying a process to the magnetic structure to alter a magnetization in at least a portion of the magnetic structure, wherein the process comprises at least one of:

applying heat to at least a portion of the magnetic structure, the heat providing a thermal field having a temperature sufficient to alter the magnetization in the portion to which the thermal field is applied;

applying a laser to at least a portion of the magnetic structure, the laser configured to provide a thermal field having a temperature sufficient to alter the magnetization in the portion to which the thermal field is applied; and configuring a magnetic printing process to implement a selective alternation of magnetic field strength in the portion to which the magnetic printing process is applied.

* * * * *